US012677877B2

(12) United States Patent
Aggarwal

(10) Patent No.: US 12,677,877 B2
(45) Date of Patent: Jul. 14, 2026

(54) SMOKING SUBSTITUTE DEVICE

(71) Applicant: Imperial Tobacco Limited, Bristol (GB)

(72) Inventor: Nikhil Aggarwal, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 501 days.

(21) Appl. No.: 17/738,586

(22) Filed: May 6, 2022

(65) Prior Publication Data

US 2022/0256923 A1 Aug. 18, 2022

Related U.S. Application Data

(63) Continuation of application No. PCT/EP2020/082118, filed on Nov. 13, 2020.

(30) Foreign Application Priority Data

| | | |
|---|---|---|
| Nov. 15, 2019 | (EP) | 19209421 |
| Nov. 15, 2019 | (EP) | 19209424 |
| Nov. 15, 2019 | (EP) | 19209428 |
| Nov. 15, 2019 | (EP) | 19209431 |
| Nov. 15, 2019 | (EP) | 19209436 |
| Nov. 15, 2019 | (EP) | 19209450 |

(51) Int. Cl.
*A24F 40/44* (2020.01)
*A24F 40/46* (2020.01)

(52) U.S. Cl.
CPC ..... *A24F 40/44* (2020.01); *A24F 40/46* (2020.01)

(58) Field of Classification Search
CPC ..... A24F 40/46; A24F 40/44; A24F 40/20; A24F 40/10; A24F 40/00
See application file for complete search history.

(56) References Cited

U.S. PATENT DOCUMENTS

| | | | | |
|---|---|---|---|---|
| 2004/0115944 | A1* | 6/2004 | Matsui | C09G 1/02 438/692 |
| 2014/0238422 | A1 | 8/2014 | Plunkett et al. | |
| 2015/0335074 | A1 | 11/2015 | Leung | |
| 2017/0042242 | A1* | 2/2017 | Hon | A61M 15/06 |

(Continued)

FOREIGN PATENT DOCUMENTS

| | | |
|---|---|---|
| CN | 106 307 617 A | 1/2017 |
| CN | 110 432 557 A | 11/2019 |

(Continued)

OTHER PUBLICATIONS

International Search Report and Written Opinion (PCT/EP2020/082118), dated Feb. 12, 2021, 14 pages.

(Continued)

*Primary Examiner* — Alex B Efta
(74) *Attorney, Agent, or Firm* — DUNLAP CODDING, P.C.

(57) ABSTRACT

A smoking substitute device is described. The device includes an electrically conductive porous wick heater. At least one electrical contact region of the wick heater is exposed from the smoking substitute device for direct engagement with a respective at least one electrical contact of a main device. The main device includes a power supply for supplying electrical energy to the at least electrical contact region via the at least one electrical contact.

14 Claims, 11 Drawing Sheets

(56) References Cited

U.S. PATENT DOCUMENTS

| | | | | |
|---|---|---|---|---|
| 2017/0333650 | A1* | 11/2017 | Buchberger | A61M 11/042 |
| 2017/0340011 | A1 | 11/2017 | Batista | |
| 2017/0340012 | A1 | 11/2017 | Mironov et al. | |
| 2018/0020737 | A1 | 1/2018 | Mironov et al. | |
| 2018/0064169 | A1 | 3/2018 | Biel et al. | |
| 2018/0116286 | A1* | 5/2018 | Polloni | A24F 40/70 |
| 2018/0140014 | A1 | 5/2018 | Yu et al. | |
| 2018/0205052 | A1 | 7/2018 | Chen | |
| 2018/0280637 | A1 | 10/2018 | Mayle et al. | |
| 2019/0246693 | A1 | 8/2019 | Nettenstrom et al. | |
| 2019/0289917 | A1 | 9/2019 | Silvestrini et al. | |
| 2019/0320721 | A1 | 10/2019 | Macko et al. | |
| 2019/0373953 | A1* | 12/2019 | Atkins | A24F 40/485 |

FOREIGN PATENT DOCUMENTS

| | | | |
|---|---|---|---|
| DE | 10 2017 123 868 | A1 | 4/2019 |
| EP | 3 476 229 | A1 | 5/2019 |
| GB | 2 533 135 | A | 6/2016 |
| WO | 2015/117700 | A1 | 8/2015 |
| WO | WO 2016/096780 | A1 | 6/2016 |
| WO | WO 2016/162446 | A1 | 10/2016 |
| WO | WO 2016/176800 | A1 | 11/2016 |
| WO | WO 2017/163050 | A1 | 9/2017 |
| WO | WO 2018/019486 | A1 | 2/2018 |
| WO | WO 2018/055333 | A1 | 3/2018 |
| WO | WO 2018/211252 | A1 | 11/2018 |
| WO | WO 2019/206985 | A1 | 10/2019 |
| WO | WO 2019/237052 | A1 | 12/2019 |

OTHER PUBLICATIONS

European Search Report (19209421.7-1004), dated Apr. 17, 2020, 8 pages.

European Search Report (19209424.1-1004), dated May 7, 2020, 8 pages.

European Search Report (19209428.2-1004), dated May 26, 2020, 8 pages.

European Search Report (19209431.6-1004), dated May 11, 2020, 8 pages.

European Search Report (19209436.5-1004), dated May 13, 2020, 8 pages.

European Search Report (19209450.6-1004), dated Apr. 22, 2020, 9 pages.

* cited by examiner

SMOKING SUBSTITUTE DEVICE

CROSS-REFERENCE TO RELATED APPLICATIONS/INCORPORATION BY REFERENCE STATEMENT

This application is a non-provisional application claiming benefit to the international application no. PCT/EP2020/082118 filed on Nov. 13, 2020, which claims priority to EP 19209421.7 filed on Nov. 15, 2019, EP 19209424.1 filed on Nov. 15, 2019, EP 19209428.2 filed on Nov. 15, 2019, EP 19209431.6 filed on Nov. 15, 2019, EP 19209436.5 filed on Nov. 15, 2019, and EP 19209450.6 filed on Nov. 15, 2019. The entire contents of each of the above-referenced applications are hereby incorporated herein by reference in their entirety.

FIELD OF THE DISCLOSURE

The present disclosure relates to an aerosol delivery device, and, more particularly but not exclusively, to a substitute smoking device including a wick heater.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapor", which is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heating device to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank or liquid reservoir for containing e-liquid, as well as a heating device. In use, electrical energy is supplied from the power source to the heating device, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a sealed tank and heating element which is pre-filled with e liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

Another example vaping smoking substitute device is the blu PROT™ e-cigarette. The blu PROT™ e cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapor which is inhaled by a user through the mouthpiece.

Another approach for a smoking substitute device is the so-called "heat not burn" ("HNB") approach in which tobacco (rather than e-liquid) is heated or warmed to release vapor. The tobacco may be leaf tobacco or reconstituted tobacco. The vapor may contain nicotine and/or flavorings. In the HNB approach the intention is that the tobacco is heated but not burned, i.e., does not undergo combustion.

A typical HNB smoking substitute device may include a main body and a consumable. The consumable may include the tobacco material. The main body and consumable may be configured to be physically coupled together. In use, heat may be imparted to the tobacco material by a heating device that is typically located in the main body, wherein airflow through the tobacco material causes moisture in the tobacco material to be released as vapor. A vapor may be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the smoking substitute device (entrained in the airflow) from an inlet to a mouthpiece (outlet), the vapor cools and condenses to form an aerosol (also referred to as a vapor) for inhalation by the user. The aerosol will normally contain the volatile compounds.

In HNB smoking substitute devices, heating as opposed to burning the tobacco material is believed to cause fewer, or smaller quantities, of the more harmful compounds ordinarily produced during smoking. Consequently, the HNB approach may reduce the odor and/or health risks that can arise through the burning, combustion and pyrolytic degradation of tobacco.

An example of the HNB approach is the IQOS® smoking substitute device from Philip Morris Ltd. The IQOS® smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapor and flavorings which may be drawn through the mouthpiece by the user through inhalation.

A second example of the HNB approach is the device known as "Gb"® from British American Tobacco p.l.c. Glo® comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapor and flavorings which may be drawn through the consumable by the user through inhalation. The tobacco, when heated by the heating device, is configured to produce vapor when heated rather than when burned (as in a smoking apparatus, e.g., a cigarette). The tobacco may contain high levels of aerosol formers (carrier), such as vegetable glycerin ("VG") or propylene glycol ("PG").

In prior art smoking substitute devices, some of the unvaporized e-liquid may leak out from the device due to leakage paths present between the components of the consumable. Additionally, it is desirable to provide consumables which are easier and cheaper to manufacture.

The present disclosure has been devised in light of the above considerations.

SUMMARY OF THE DISCLOSURE

According to some exemplary embodiments there is provided a smoking substitute device, for instance a consumable assembly, having a wick heater housed in a housing, wherein the wick heater is exposed to the exterior of the housing for direct engagement with an electrical contact of a main device. Providing a direct electrical contact to the wick heater simplifies the electrical connection of the consumable to the main device containing the power source, for instance the battery. The simplified electrical connection also acts to reduce the leakage points.

According to further exemplary embodiments, there is provided a smoking substitute device having a wick heater wherein liquid supply passages are provided to supply aerosol liquid to the wick heater in a direction that is perpendicular to a plane of the wick heater. The liquid supply passages are formed through a transfer member and may comprise open passages or holes. The liquid supply passages are suitably sized to supply liquid to the wick heater via capillary action. Providing the liquid supply passages to supply the liquid via capillary action perpendicularly to the plane of the wick heater allows the liquid supply passages to be easily formed. The arrangement of the liquid supply passages also assists in reducing leakage as the wick heater can extend in a direction of potential leakage According to further exemplary embodiments, there is provided a method of manufacturing a smoking substitute device wherein an electrically conductive additive is applied to the wick heater to form an electrical connection region. Suitably, the wick heater is assembled in a housing to form the smoking substitute device, being a consumable for connecting to a main device, wherein the electrical connection regions are exposed to the exterior of the housing to allow direct connection of the wick heater to electrical connections of the main device. The improved electrical connection regions provide a simplified manufacturing process including a more reliable direct connection.

According to further exemplary embodiments, there is provided a smoking substitute device having a transfer member that closes an end of a liquid supply tank, the transfer member including a liquid supply passage, a vapor outlet and a cavity, wherein the transfer member is arranged relative to the wick heater so that the cavity forms an empty space downstream of the wick heater. Here, the vapor outlet is formed in the cavity. And the liquid supply passage is not formed in the cavity. Thus, the feed locations on the wick heater where the liquid supply passages supply the liquid are offset from the vapor outlet. Offsetting the liquid supply passages and the vapor outlet means the liquid is not directly supplied to the area of the wick heater in the main airflow and reduces the likelihood of liquid being carried off the wick heater without vaporization, which can lead to leakage, for instance at the mouthpiece.

According to further exemplary embodiments, there is provided a smoking substitute device having a wick heater, wherein the wick heater has a narrowing and the narrowing is provided to one side of a liquid supply region and to the other side of the liquid supply region there is provided a compression region. The compression region at least partially surrounds or isolates an electrical connection region. Here, the compression region compresses the wick heater. Said compression reduces the porosity of the wick heater and thereby provides a resistance to liquid wicking from the liquid supply region to the electrical connection region. Thus, the wick heater can be electrically connected, with the wick heater reaching a desired temperature at the narrowing, whilst maintain a lower temperature at the liquid supply region and electrical connection regions, whilst reducing the risk of leakage at the electrical connection region.

According to further exemplary embodiments, there is provided a smoking substitute device having a wick heater, wherein a barrier region is provided to reduce or inhibit the flow of liquid aerosol towards an electrical connection region. Suitably, the barrier region is a gasket formed on an upstream plate. The upstream plate is arranged relative to the wick heater so that the gasket compresses the wick heater. Here, suitably, the upstream plate may cooperate with a downstream plate, or transfer member, to assemble the wick heater in position. For instance, the upstream plate may have an aperture aligned with an electrical connection region. The wick heater may be sandwiched between the upstream plate and the downstream plate to be assembled in position. Using a barrier region to reduce or inhibit the flow of liquid to an electrical connection region reduces the risk of leakage at the electrical connection region.

Each of the above exemplary embodiments may be combined with the others in isolation or in combination. Further features of the exemplary embodiments are described below in relation to exemplary aspects and embodiments wherein the features of the exemplary embodiments are suitable for any or all of the above exemplary embodiments in isolation or combination with other features except where the features are mutually incompatible.

According to a first exemplary aspect, there is provided a smoking substitute device including: an electrically conductive porous wick heater; wherein at least one electrical contact region of the wick heater is exposed from the smoking substitute device for direct engagement with a respective at least one electrical contact of a main device, the main device including a power supply for supplying electrical energy to the at least electrical contact region via the at least one electrical contact.

In the exemplary embodiments, the electrical connection region may be one or more electrical connection regions. For instance, in some exemplary embodiments two electrical connection regions are provided, wherein the first electrical connection region is spaced across the wick heater to the second electrical connection region. Herein, references to the electrical connection region may be references to the or each electrical connection region, for instance each of the first and/or the second electrical connection region.

In some exemplary embodiments, the wick heater is substantially planar. Here, the or each electrical connection region of the wick heater is suitably formed on an upstream surface of the wick heater. The planar wick heater has a length in a longitudinal dimension, a width in a transverse dimension and a thickness in a depth direction. Typically, the depth is significantly smaller than the length or width. Suitably, the length is greater than the width. In the exemplary embodiments, the planar wick heater has a cross sectional thickness that is substantially constant in the length and width dimensions. Thus, the planar wick heater has a plane substantially parallel to an upstream face of the planar wick heater and/or a downstream face of the planar wick heater. The upstream and downstream faces being planar and extending in the length and width directions.

In some exemplary embodiments, each electrical contact region is for engagement with the respective electrical contact of the main device from a contact direction that is substantially parallel to a longitudinal axis of the smoking substitute device. Here, the smoking substitute device is configured to be operatively connected to the main device by at least movement in a direction parallel to the longitudinal axis.

In the exemplary embodiments including a planar wick heater, the plane of the wick heater is substantially perpendicular to the longitudinal axis of the smoking substitute device.

In some exemplary embodiments, the smoking substitute device includes a cover that obscures at least a portion of the wick heater, wherein the cover includes at least one electrical contact aperture through which the at least one respective electrical contact region is exposed for engagement with the respective electrical contact. Here, the cover comprises at least a part of the housing in which the wick heater is housed. Thus, the electrical connection regions are exposed to an exterior of the housing, through the electrical contact apertures through the cover. In some exemplary embodiments, the cover comprises an upstream plate. For instance, the upstream plate may include compression regions, such as the gaskets of other exemplary embodiments.

In the exemplary embodiments including a planar wick heater, each at least one electrical contact region is configured such that the respective electrical contact is incident on the respective electrical contact region from a direction perpendicular to the plane of the wick heater.

In some exemplary embodiments, the smoking substitute device includes a store for supplying aerosol forming substrate to the wick heater. For instance, a tank. Suitably, the aerosol forming substrate is supplied to one surface of the wick heater and said at least one electrical connection region of the wick heater is formed on a different surface of the wick heater. In some exemplary embodiments, the electrical connection region is formed on an upstream surface and the downstream surface of the wick heater includes the liquid supply region, which is the region to which the aerosol liquid is supplied.

In the exemplary embodiments including a store and a planar wick heater, the aerosol forming substrate is supplied from the store to the wick heater along a direction substantially perpendicular to the plane of the wick heater.

In the exemplary embodiments, the aerosol forming substrate is supplied to the wick heater at at least one feed location on the wick heater, wherein the at least one electrical contact region includes a first electrical contact region and a second electrical contact region, and wherein the at least one feed location is located between the first electrical contact region and the second electrical contact region. Here, the feed location may comprise one or more feed locations, for instance, a plurality of feed locations. Suitably, there may be four feed locations. The feed locations suitably correspond to locations on the wick heater adjacent exits from the liquid supply passages.

In some exemplary embodiments, the wick heater includes an electrically conductive fabric. Suitably, a barrier region may be provided to compress the wick heater in a region between said at least one electrical contact region and a heating zone of the wick heater. For instance, the barrier region may be the gasket of other exemplary embodiments.

In some exemplary embodiments, the wick heater includes carbon fibers.

According to a further exemplary aspect, there is provided a smoking substitute system including, a smoking substitute device according to the exemplary aspects, and; the main device. Here, the smoking substitute device is a consumable that is operatively connectable to the main device. Suitably, the operative connection between the consumable and main device forms an electrical connection. For instance, the main body has an electrical connector or contact that directly abuts a connection region of the wick heater.

In exemplary embodiments, the at least one electrical contact includes a non-pointed electrical engagement region for direct engagement with the respective electrical contact region. Optionally, the non-pointed electrical engagement region includes a substantially flat portion. Optionally, the substantially flat portion is for co-planar engagement with the respective electrical contact region.

In some exemplary embodiments, the at least one electrical contact is resiliently mounted in the main device and biased to engage the electrical contact region of the wick heater.

According to a further exemplary aspect, there is provided a smoking substitute device including: an electrically conductive porous wick heater; a store for containing aerosol forming substrate; and a transfer member. Suitably, the transfer member is configured to convey aerosol forming substrate from the store to the wick heater. For instance, the transfer member includes at least one liquid supply passage configured to convey aerosol forming substrate from the store to the wick heater via capillary action. Here, the liquid supply passage extends between the store and the wick heater. Each liquid supply passage is configured to supply an aerosol forming substrate (e.g., a liquid) from the store to the wick heater. Here, the liquid supply passage supplies the aerosol forming substrate along a supply direction that is perpendicular to a plane of the wick heater. For instance, the wick heater is a substantially planar wick heater.

Suitably, the at least one liquid supply passage is a plurality of liquid supply passages. For instance, a first liquid supply passage and a second liquid supply passage. In exemplary embodiments there are four liquid supply passages. Suitably, the or each liquid supply passage may be substantially similar and references to the or each liquid supply passage may apply to all liquid supply passages.

In some exemplary embodiments, the wick heater includes an electrically conductive fabric. For instance, optionally, the wick heater includes carbon fibers. Suitably, in some exemplary embodiments at least a portion of the wick heater is hydrophilic. Here, the wick heater may include a hydrophilic coating.

In some exemplary embodiments, a respective outlet of the at least one liquid supply passage (i.e., capillary channel) is located adjacent the wick heater at a respective feed location, wherein each respective feed location is located between a first electrical connection region of the wick heater and a second electrical connection region of the wick heater.

In some exemplary embodiments, a channel diameter of the or each at least one liquid supply passage is between 0.1 mm and 1.0 mm.

In some exemplary embodiments, a channel length of the or each at least one liquid supply channel is between 1.0 mm and 5.0 mm.

In exemplary embodiments including a store, the store may suitably include a liquid aerosol forming substrate, and optionally, wherein the liquid aerosol forming substrate has a viscosity between 100 and 300 centistokes.

In some exemplary embodiments, a portion of the wick heater is located within a heating chamber of the substitute smoking device. Here, the heating chamber suitably has an aerosol outlet leading to a device outlet of the smoking substitute device. The at least one liquid supply passage may comprise a first and second liquid supply passage or a first group of liquid supply passages and a second group of liquid supply passages, wherein the first liquid supply passage or first group of liquid supply passages (i.e., first capillary channels) are arranged on a first side of the aerosol outlet and the second liquid supply passage or second group of liquid supply passages (i.e., second capillary channels) are arranged on a second, opposite, side of the aerosol outlet.

In some exemplary embodiments, the at least one liquid supply passage is substantially parallel to a longitudinal axis of the smoking substitute device. Suitably, the wick heater is a planar wick heater and a plane of the planar wick heater is perpendicular to a longitudinal axis of the smoking substitute device.

In some exemplary embodiments the transfer member is formed from a non-porous material. That is, the liquid supply passage is formed through a non-porous material. In some exemplary embodiments comprising a transfer member, the transfer member may be a downstream plate. In the exemplary embodiments wherein the transfer member of downstream plate are non-porous, the transfer member suitably forms a closure of a store (e.g., tank for the aerosol liquid).

According to a further exemplary aspect, there is provided a smoking substitute system including: a smoking substitute device according to the exemplary aspects; and a main body, wherein the smoking substitute device and main body are configured be mutually engaged such that electrical power may be supplied from the main body to the wick heater. The smoking substitute device may include: an electrically conductive porous wick heater; a store for containing aerosol forming substrate; and a transfer member. Suitably, the transfer member is configured to convey aerosol forming substrate from the store to the wick heater. For instance, the transfer member includes at least one liquid supply passage configured to convey aerosol forming substrate from the store to the wick heater via capillary action. Here, the liquid supply passage extends between the store and the wick heater. Each liquid supply passage is configured to supply an aerosol forming substrate (e.g., a liquid) from the store to the wick heater. Here, the liquid supply passage supplies the aerosol forming substrate along a supply direction that is perpendicular to a plane of the wick heater.

According to a further aspect, there is provided a smoking substitute device including: an electrically conductive porous wick heater located in a vaporization chamber, the vaporization chamber having a vapor outlet for conveying vapor to a device outlet of the device; a store for containing aerosol forming substrate for supply to the wick heater; and a transfer member. The transfer member forms a sealing wall of the store. The transfer member includes a liquid supply passage configured to supply the aerosol forming substrate to at least one feed location on the wick heater. The transfer member further includes a cavity to form an empty space downstream of the wick heater wherein the vapor outlet is formed through the transfer member from the cavity. Here, the at least one feed location is located between a first electrical connection region of the wick heater and a second electrical connection region of the wick heater. The liquid supply passage is not formed in the cavity so that the at least one feed location is offset from the vapor outlet.

In some exemplary embodiments, the at least one feed location includes a first and second feed location. Optionally, the first feed location is located on an opposing side of the vapor outlet to the second feed location.

In exemplary embodiments comprising a planar wick heater, the wick heater is substantially planar. Here, the at least one feed location may be located on an upper surface of the substantially planar wick heater. That is on the downstream surface of the wick heater. Likewise, the first and second electrical connection regions may be located on a lower surface of the planar wick heater, opposite to the upper surface. That is on the upstream surface of the wick heater In exemplary embodiments, the transfer member includes at least one liquid supply passage, for instance a capillary passage, and wherein each of the at least one feed location corresponds to an end of a respective liquid supply passage (e.g., capillary passage).

In exemplary embodiments comprising capillary passages, each of the at least one capillary passages extends between the store and the wick heater, passing through the transfer member.

In some exemplary embodiments, the smoking substitute device may include the aerosol forming substrate, for instance the liquid aerosol. That is, the smoking substitute device comprises a store and the store is filled with the aerosol forming substrate. Here, the aerosol forming substrate may have a viscosity of between 100 and 300 centistokes.

In some exemplary embodiments, the wick heater includes at least one barrier region. For instance, a gasket. The barrier region is configured to interact with the wick heater to generate a reduced porosity of the wick heater at the barrier region. Suitably, the barrier region may be a compressed region of the wick heater. For instance, the barrier region (e.g., the gasket) is arranged to compress the wick heater.

In exemplary embodiments including a barrier region, the at least one barrier region is suitably located between one of the first and second electrical connection regions and one of the at least one feed locations.

In exemplary embodiments including a barrier region, the device may include two barrier regions. That is, the barrier region may comprise a first barrier region and a second barrier region. Here, optionally, the first barrier region may be located between the first electrical connection region and the at least one feed location; and the second barrier region may be located between the second electrical connection region and the at least one feed location.

In exemplary embodiments including a barrier region, the barrier region provides a lower wick porosity at the barrier region and the wick heater has a higher wick porosity outside the barrier region.

In exemplary embodiments including the liquid supply passages, the liquid supply passages may be configured for supplying the liquid via capillary action. Here the at least one capillary passage has an opening width of between 0.1 and 1.0 millimeters. Optionally, the at least one capillary passage has a passage length of between 1.0 and 5.0 millimeters. And suitably, the aerosol forming substrate has a viscosity of between 100 and 300 centistokes.

According to a further exemplary aspect there is provided a smoking substitute system, including a substitute smoking device according to the exemplary aspects, and further including a main body device, wherein the main body is configured to supply electrical current between the first and second electrical connection regions. Here, a transfer member closes an end of a liquid supply tank, the transfer member including a liquid supply passage, a vapor outlet and a cavity, wherein the transfer member is arranged relative to the wick heater so that the cavity forms an empty space downstream of the wick heater. Here, the vapor outlet is formed in the cavity. And the liquid supply passage is not formed in the cavity. Thus, the feed locations on the wick heater where the liquid supply passages supply the liquid are offset from the vapor outlet.

According to a further exemplary aspect, there is provided a method of manufacture of a smoking substitute device including the steps of: providing an electrically conductive porous wick heater; applying an electrically conductive additive to at least an electrical connection region of the wick heater; permeating the electrically conductive additive into the wick heater; and hardening the electrically conductive additive. The method may further comprise assembling the wick heater in a housing to from said smoking substitute device, the assembling comprising exposing the electrical connection region to the outside of the housing; the smoking substitute device being suitable for coupling with a main body, the main body having electrical connections such that the electrical connections make direct contact with said at least one electrical connection region.

According to the exemplary method, optionally the wick heater is fibrous. Optionally, the fibers of the fibrous wick heater are electrically conductive. Optionally, the fibers include carbon fibers. Optionally, the wick heater includes a fabric. Optionally, the fabric is woven. Optionally, the electrically conductive additive permeates into interstices between the yarns of the fabric.

Optionally, the electrical connection region includes first and second, separate, electrical connection region. Optionally, the wick heater is planar. Here, according to some exemplary embodiments, the method may comprise applying the electrically conductive additive to a planar surface of the planar wick heater.

In some exemplary embodiments, the method comprises permeating the electrically conductive additive into the wick heater to a permeation depth, wherein the permeation depth is less than a depth of the wick heater.

In some exemplary embodiments, the method includes flattening an exposed surface of the electrically conductive additive at the electrical connection region.

According to a further exemplary aspect, there is provided a wick heater produced according to the method of the exemplary aspects.

According to a further exemplary aspect, there is provided a smoking substitute device including a wick heater, the wick heater having at least one electrical connection region exposed to the outside for direct contact with electrical connections of a main body, the wick heater is an electrically conductive porous wick heater having electrical connection regions that comprise areas of hardened conductive additive that fill said region of the porous wick heater. Suitably, a permeation depth of the conductive additive may be less than a depth of the wick heater.

According to a further exemplary aspect, there is provided a smoking substitute system including a smoking substitute device according to the exemplary aspects, and further including a main body device for engagement with the smoking substitute device, the main body device including a power supply and at least one electrode (e.g., electrical contact), the at least one electrode being configured to make direct electrical connection to a respective electrical connection region of the wick heater.

According to a further exemplary aspect, there is provide a smoking substitute device including: an elongate porous wick for conveying liquid aerosol forming substrate to a heating zone from a liquid supply location, a store for containing the liquid aerosol forming substrate for supply to the wick at the liquid supply location of the wick; the wick including a pair of spaced electrical connection regions, the heating zone being located electrically between the pair of electrical connection regions; wherein the wick is configured to have a lower liquid flow rate along the wick at at least one barrier region of the wick and a higher liquid flow rate of the liquid aerosol forming substrate along the wick outside the at least one barrier region, the at least one barrier region being located to promote maintenance of the liquid aerosol forming substrate in the heating zone and to inhibit flow of liquid aerosol forming substrate towards at least one of the electrical connection regions.

In the exemplary embodiments having a barrier region, suitably the at least one barrier region is located between the electrical connection regions.

In the exemplary embodiments having a barrier region, suitably, the at least one barrier region includes two barrier regions. Here, optionally, each of the two barrier regions is located on a respective side of the heating zone along the wick. In some exemplary embodiments, the first barrier region and the second barrier region are substantially similar. Each further barrier region may also be substantially similar. Features of the barrier region may apply to the or each barrier region as appropriate.

In the exemplary embodiments having a barrier region, suitably, the or each barrier region substantially prevents liquid aerosol forming substrate being conveyed through the respective barrier region.

In the exemplary embodiments having a barrier region, optionally, the wick is electrically conductive.

In the exemplary embodiments having a heating zone, the heating zone may be a portion of the wick.

In the exemplary embodiments having a barrier region, a barrier porosity of the wick in each barrier region is suitably lower than a wick porosity outside the barrier region. Here, optionally, the barrier porosity is at least 3 times lower than the wick porosity.

In the exemplary embodiments having a barrier, the wick may be substantially planar. For instance, the wick may be a planar wick heater. In exemplary embodiments, the planar wick has a major plane. Here, optionally, the major plane of the wick is substantially perpendicular to an in-use direction of airflow through the device. Furthermore, optionally, the liquid aerosol forming substrate is supplied to the wick in a direction substantially perpendicular to the major plane.

In some exemplary embodiments, the wick is compressed to thereby form the at least one barrier region. In the exemplary embodiments wherein the wick has a major plane, the wick may be compressed in a dimension perpendicular to the major plane of the wick. Here, optionally, each electrical contact region may be for engagement with a respective electrical supply electrode from a direction perpendicular to the major plane.

According to a further exemplary aspect, there is provided a smoking substitute system including a substitute smoking device according to the exemplary aspects, and further including a main device for electrical engagement with the smoking substitute device. The smoking substitute device including: an elongate porous wick for conveying liquid aerosol forming substrate to a heating zone from a liquid supply location, a store for containing the liquid aerosol forming substrate for supply to the wick at the liquid supply location of the wick; the wick including a pair of spaced electrical connection regions, the heating zone being located electrically between the pair of electrical connection regions; wherein the wick is configured to have a lower liquid flow rate along the wick at at least one barrier region of the wick and a higher liquid flow rate of the liquid aerosol forming substrate along the wick outside the at least one barrier region, the at least one barrier region being located to promote maintenance of the liquid aerosol forming substrate in the heating zone and to inhibit flow of liquid aerosol forming substrate towards at least one of the electrical connection regions.

According to a further exemplary aspect there is provided a smoking substitute device including: an elongate planar wick heater for vaporizing aerosol forming substrate, wherein the heater has a length in a longitudinal dimension, a width in a transverse dimension and a thickness in a depth dimension; the wick heater having two mutually opposed transverse sides along the length of the wick heater. The wick heater having a lateral narrowing thereby reducing the width of the wick heater in the transverse dimension in a heating portion of the wick heater. The wick heater includes an electrical connection region, a liquid supply location and a compression region, wherein the compression region compresses the wick heater; and the compression region is provided between the electrical connection region and the liquid supply location.

In some exemplary embodiments an airflow passage is formed between the lateral narrowing and an adjacent heating chamber wall of the device.

In some exemplary embodiments, one or both of the two mutually opposed transverse sides includes a respective convex curved portion to form the lateral narrowing. Here, suitably the curved portions are mutually convex with respect to one another.

In some exemplary embodiments, the smoking substitute device includes a respective airflow passage formed between each opposed transverse side at the lateral narrowing (e.g., the convex curved portion) and a respective adjacent heating chamber wall of the device.

In some exemplary embodiments, the heater is substantially symmetrical along a transverse axis of symmetry.

In some exemplary embodiments, the heater is substantially symmetrical along a longitudinal axis of symmetry.

In some exemplary embodiments, the heater is porous.

In some exemplary embodiments, the heater is formed from a fabric, optionally wherein the fabric is woven. Here, optionally, the fabric is electrically conductive.

In some exemplary embodiments, the heater includes a pair of electrical connection regions, and wherein the heating portion is located electrically between the electrical connection regions.

In the exemplary embodiments having a lateral narrowing formed with convex portions, the curved portion may have a radius of curvature that is greater than 2 millimeters. Optionally, the curved portion has a radius of curvature that is less than 50 millimeters, optionally less than 10 millimeters.

According to a further exemplary aspect, there is provided a smoking substitute system including a smoking substitute device according to the exemplary aspects, and further including a main body device for engagement with the smoking substitute device, the main body device including a power supply and at least one electrode, the at least one electrode being for electrical connection to the heater. The smoking substitute device including: an elongate planar wick heater for vaporizing aerosol forming substrate, wherein the heater has a length in a longitudinal dimension, a width in a transverse dimension and a thickness in a depth dimension; the wick heater having two mutually opposed transverse sides along the length of the wick heater. The wick heater having a lateral narrowing thereby reducing the width of the wick heater in the transverse dimension in a heating portion of the wick heater. The wick heater includes an electrical connection region, a liquid supply location and a compression region, wherein the compression region compresses the wick heater; and the compression region is provided between the electrical connection region and the liquid supply location.

The disclosure includes the combination of the aspects and preferred features described except where such a combination is clearly impermissible or expressly avoided.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

Figure 1A:
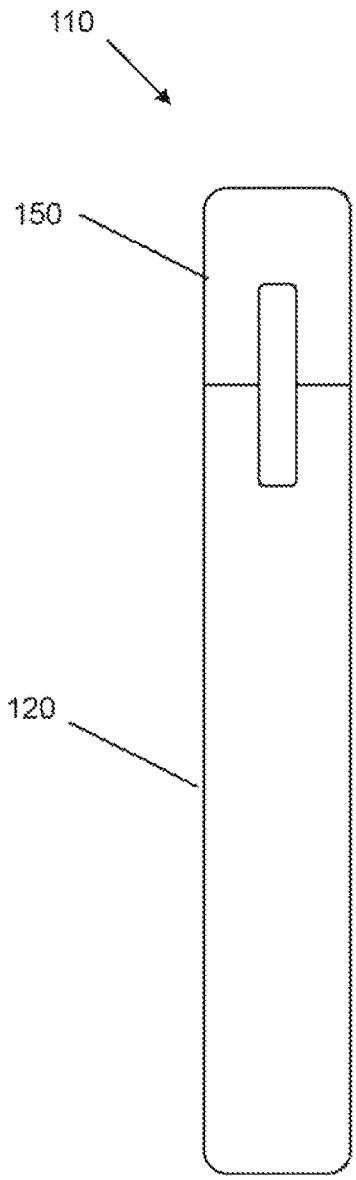
FIG. 1A is a side view of a smoking substitute device according to an embodiment.

FIG. 1A shows an aerosol delivery device, which is a smoking substitute device 110. In this example, the smoking substitute device 110 includes a main body 120 and a consumable 150. The consumable 150 may alternatively be referred to as a "pod". The consumable 150 may also be referred to as a cartridge or cartomizer. In other examples, the term "aerosol delivery device" may apply to the consumable 150 alone rather than the smoking substitute device 110.

In this example, the smoking substitute device 110 is a closed system vaping device, wherein the consumable 150 includes a sealed tank or liquid reservoir 156 and is intended for one-use only.

FIG. 1A shows the smoking substitute device 110 with the main body 120 physically coupled to the consumable 150.

Figure 1B:
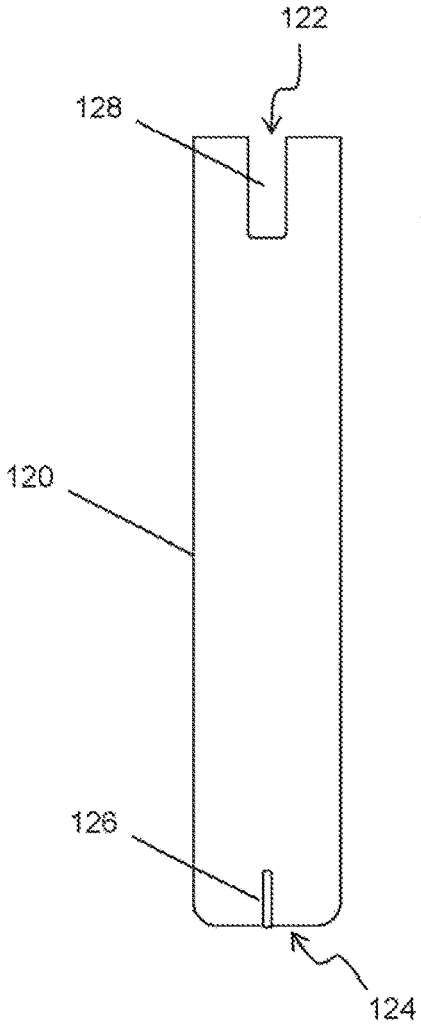
FIG. 1B is a side view of main body of the smoking substitute device according to an embodiment.

FIG. 1B shows the main body 120 of the smoking substitute device 110 without the consumable 150.

Figure 1C:
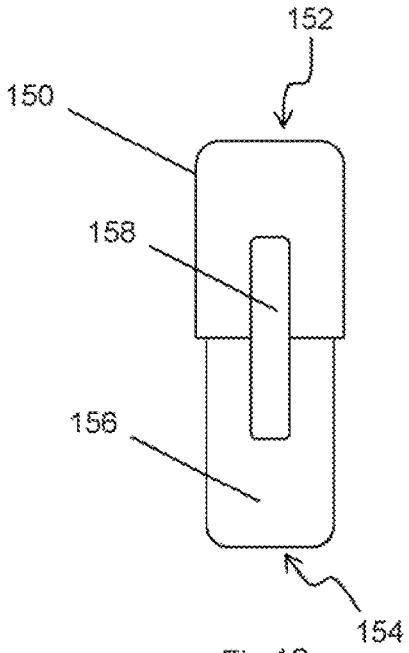
FIG. 1C is a side view of consumable of the smoking substitute device according to an embodiment.

FIG. 1C shows the consumable 150 of the smoking substitute device 110 without the main body 120.

The main body 120 and the consumable 150 are configured to be physically coupled together, in this example by pushing the consumable 150 into an aperture in a top end 122 of the main body 120, such that there is an interference fit between the main body 120 and the consumable 150. In other examples, the main body 120 and the consumable could be physically coupled together by screwing one onto the other, or through a bayonet fitting, for example. An optional light 126, e.g., an LED, located behind a small translucent cover, is located a bottom end 124 of the main body 120. The light 126 may be configured to illuminate when the smoking substitute device 110 is activated.

The consumable 150 includes a mouthpiece (not shown in FIG. 1*a-c*) at a top end 152 of the consumable 150, as well as one or more air inlets (not shown) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

The tank 156 may be referred to as a "clearomizer" if it includes a window 158, or a "cartomizer" if it does not.

The consumable 150 may identify itself to the main body 120, via an electrical interface, RFID chip, or barcode.

Figure 2A:
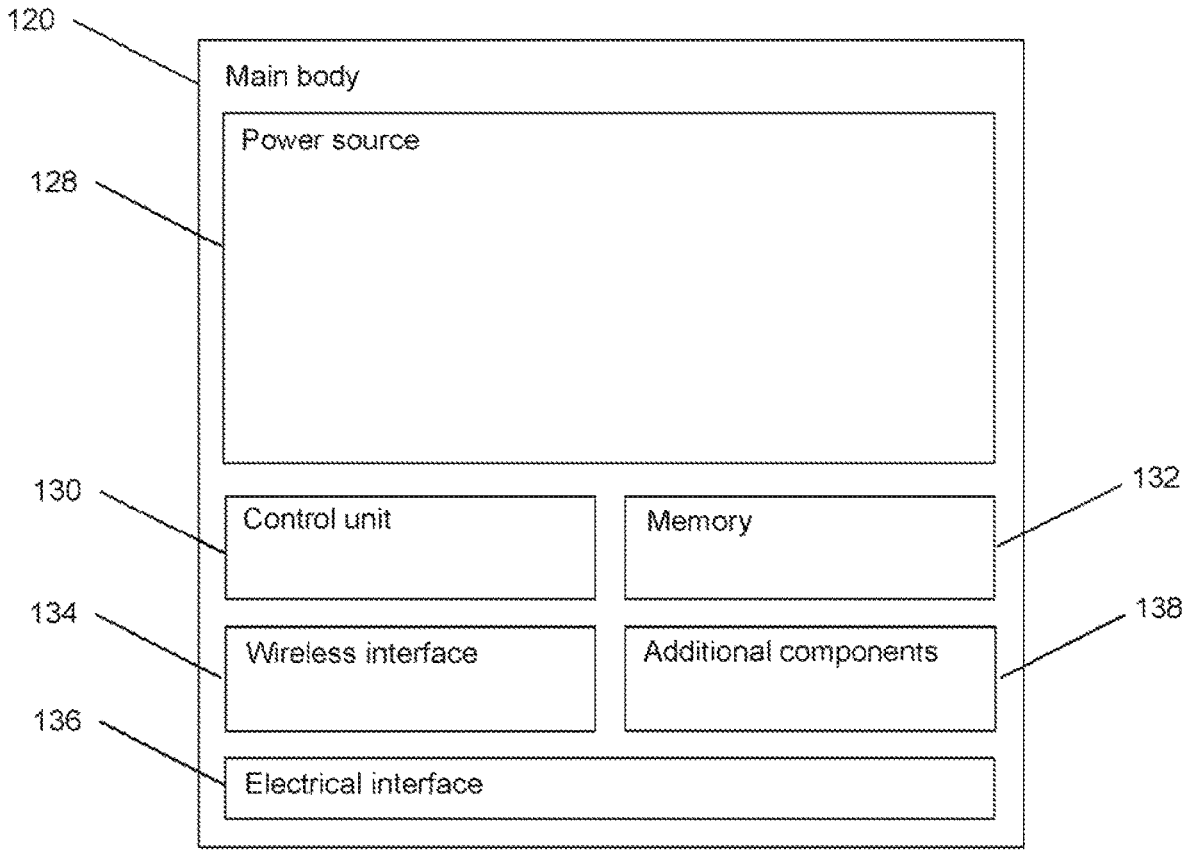
FIG. 2A is a schematic drawing of the main body according to an embodiment.

FIG. 2A is a schematic drawing of the main body 120 of the smoking substitute device 110.

Figure 2B:
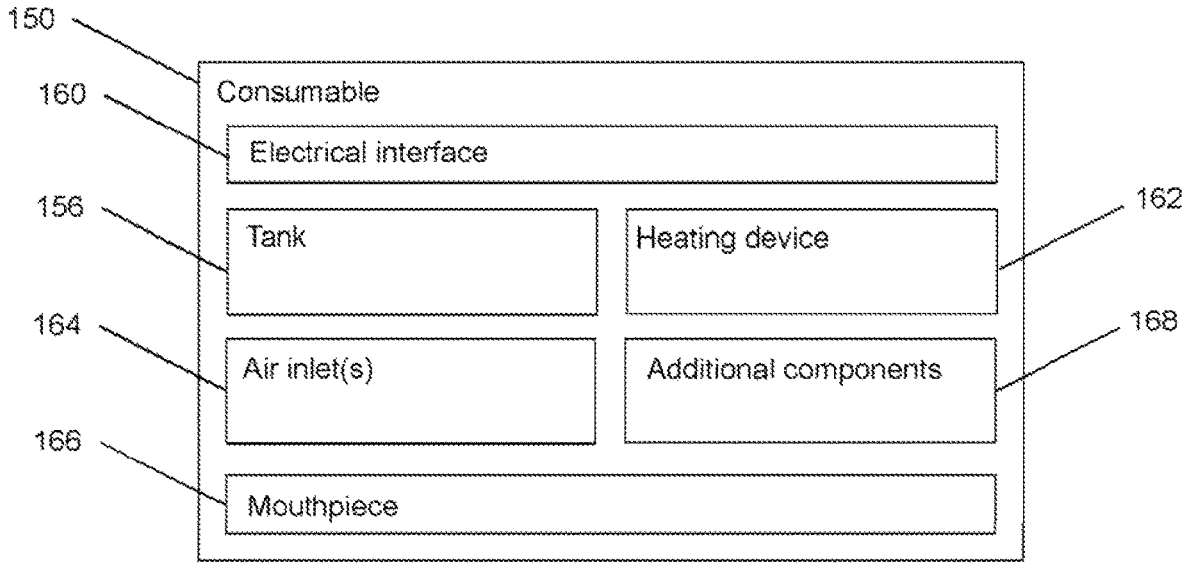
FIG. 2B is a schematic drawing of the consumable according to an embodiment.

FIG. 2B is a schematic drawing of the consumable 150 of the smoking substitute device 110.

As shown in FIG. 2A, the main body 120 includes a power source 128, a control unit 130, a memory 132, a wireless interface 134, an electrical interface 136, and, optionally, one or more additional components 138.

The power source 128 is preferably a battery, more preferably a rechargeable battery.

The control unit 130 may include a microprocessor, for example.

The memory 132 is preferably includes non-volatile memory. The memory may include instructions which, when implemented, cause the control unit 130 to perform certain tasks or steps of a method.

The wireless interface 134 is preferably configured to communicate wirelessly with another device, for example a mobile device, e.g., via Bluetooth®. To this end, the wireless interface 134 could include a Bluetooth® antenna. Other wireless communication interfaces, e.g., WIFI®, are also possible. The wireless interface 134 may also be configured to communicate wirelessly with a remote server.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g., a heating device of) the consumable 150 when the smoking substitute device 110 is activated, e.g., via the electrical interface 160 of the consumable 150 (discussed below). The electrical interface may be configured to receive power from a charging station, when the main body 120 is not physically coupled to the consumable 150 and is instead coupled to the charging station. The electrical interface 136 may also be used to identify the consumable 150 from a list of known consumables. For example, the consumable may be a particular flavor and/or have a certain concentration of nicotine. This can be identified to the control unit 130 of the main body 120 when the consumable is connected to the main body. Additionally, or alternatively, there may be a separate communication interface provided in the main body 120 and a corresponding communication interface in the consumable 150 such that, when connected, the consumable can identify itself to the main body 120.

The additional components 138 of the main body 120 may comprise the optional light 126 discussed above.

The additional components 138 of the main body 120 may, if the power source 128 is a rechargeable battery, comprise a charging port configured to receive power from the charging station. This may be located at the bottom end 124 of the main body 120. Alternatively, the electrical interface 136 discussed above is configured to act as a charging port configured to receive power from the charging station such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station (if present).

The additional components 138 of the main body 120 may include an airflow sensor for detecting airflow in the smoking substitute device 110, e.g., caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example). The airflow sensor can be used to determine, for example, how heavily a user draws on the mouthpiece or how many times a user draws on the mouthpiece in a particular time period.

The additional components 138 of the main body 120 may include an actuator, e.g., a button. The smoking substitute device 110 may be configured to be activated when the actuator is actuated. This provides an alternative to the airflow sensor noted, as a mechanism for activating the smoking substitute device 110.

As shown in FIG. 2B, the consumable 150 includes the tank 156, an electrical interface 160, a heating device 162, one or more air inlets 164, a mouthpiece 166, and, optionally, one or more additional components 168. The consumable 150 includes a heater chamber 170, which contains the heating device 162.

The electrical interface 160 of the consumable 150 may include one or more electrical contacts. In an embodiment, the electrical contacts may each be considered as parts of the heating device 162. The electrical interface 136 of the main body 120 and an electrical interface 160 of the consumable 150 are preferably configured to contact each other and thereby electrically couple the main body 120 to the consumable 150 when the bottom end 154 of the consumable 150 is inserted into the top end of the main body 122 (as shown in FIG. 1A, see also FIG. 3) to physically coupled the consumable 150 to the main body 120. In this way, electrical energy (e.g., in the form of an electrical current) is able to be supplied from the power source 128 in the main body 120 to the heating device 162 in the consumable 150.

The heating device 162 is preferably configured to heat e-liquid sourced from the tank 156, e.g., using electrical energy supplied from the power source 128, in order to vaporize the e-liquid. The tank 156 is an example of a store for supplying aerosol forming substrate (e.g., e-liquid) to the heating device 162.

The one or more air inlets 164 are preferably configured to allow air to be drawn into the smoking substitute device 110, when a user inhales through the mouthpiece 166. When the consumable 150 is physically coupled to the main body 120, the air inlet 164 receives air which flows from the top end 122 of the main body 120, between the main body 120 and the bottom end 154 of the consumable 150.

In use, a user activates the smoking substitute device 110, e.g., through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapor which is inhaled by a user through the mouthpiece 166.

As an example of one of the one or more additional components 168, an interface for obtaining an identifier of the consumable may be provided. As discussed above, this interface may be, for example, an RFID reader, a barcode or QR code reader, or an electronic interface which is able to identify the consumable to the main body. The consumable may, therefore include any one or more of an RFID chip, a barcode or QR code, or memory within which is an identifier and which can be interrogated via the electronic interface in the main body.

Of course, a skilled reader would readily appreciate that the smoking substitute device 110 shown in FIGS. 1 and 2 shows just one example implementation of a smoking substitute device, and that other forms of smoking substitute device could be used.

As another example, an entirely disposable (one use) smoking substitute device could be used as the smoking substitute device.

Figure 3:
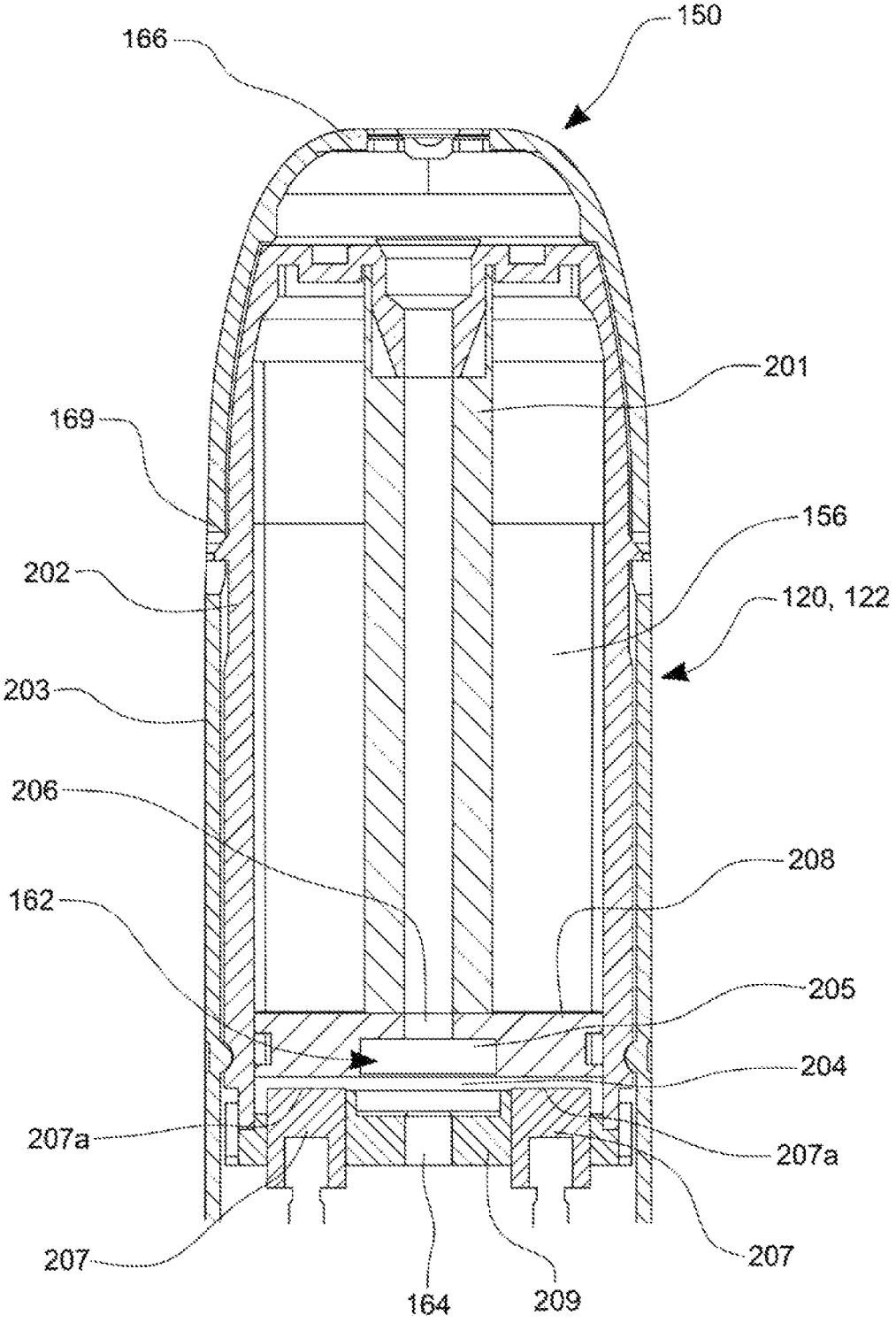
FIG. 3 is a cross-section of the consumable according to an embodiment.

FIG. 3 shows a cross-sectional view of a consumable 150 according to an embodiment of smoking substitute device. The consumable 150 comprises a tank 156 for storing e-liquid, a mouthpiece 166 and an outlet tube 201, which in this example is a chimney or tube. The tank 156 surrounds the outlet tube 201, with the outlet tube 201 extending through a central portion of the tank 156. The outlet tube 201 has a substantially circular cross-section although this is not necessarily the case in all embodiments.

The tank 156 is provided by an outer casing of the consumable 150. The outer casing of the consumable 150 comprises a tank wall 202. The tank wall 202 extends completely around the outlet tube 201 to define the tank 156 in the form of an annulus between the outlet tube 201 and the tank wall 202. The tank wall 202 extends from the bottom of the consumable 150 up to the mouthpiece 166. Where the tank wall 202 meets the mouthpiece 166, the mouthpiece 166 has a larger outer width than the tank 156, which means that there is a lip 169 around the bottom of the mouthpiece 166.

In FIG. 3 the consumable 150 is illustrated engaged with the top end 122 of the main body device 120 (see FIG. 2).

Because FIG. 3 is shown in cross section, an outer wall 203 of the top end 122 of the main body device 120 is visible. The lip 169 abuts a peripheral rim of the outer wall 203 when the consumable 150 is engaged with the main body device 120.

As discussed above, the consumable 150 includes the heater device 162. The heater device 162 includes a wick heater 204. In some embodiments the wick heater 204 is formed from an electrically conductive fabric, e.g., a fabric including carbon fibers. The electrically conductive fabric may be a sheet of electrically conductive fabric. The wick heater 204 is porous. The pores of the wick heater 204 may be interstices formed by the fabric. The porosity of the wick heater 204 enables the wick heater 204 to wick/convey the e-liquid within the wick heater 204. The electrical conductivity of the wick heater 204 allows the e-liquid to be heated and consequently vaporized via resistive heating of the wick heater 204 when electrical current is passed through the wick heater 204. At the most general, the wick heater 204 is a component that is configured to convey/store e-liquid within itself and which is also configured to be heated to vaporize at least a portion of the e-liquid contained therein.

The wick heater 204 is generally elongate. In other words, the wick heater 204 a longer major axis and a relatively shorter minor transverse axis. The wick heater 204 also a depth. In some embodiments, the depth may be less than the width. In some embodiments, the width may be substantially equal to the depth.

The wick heater 204 is generally planar. The wick heater 204 has a major plane, which may correspond to the surface of the wick heater 204 having the largest surface are. When the wick heater 204 is located within the consumable 150, the major plane is not necessarily flat across the whole of the wick heater 204. In some embodiments, at least a portion of the major plane of the wick heater 204 may be curved or bent, for example along at least a portion of the major and/or minor axes.

The wick heater 204 spans across a heater chamber 205. The heater chamber 205 includes a cavity formed in the consumable 150. The heater chamber 205 forms a cavity in which the e-liquid is vaporized from the wick heater 204. The wick heater 204 may be suspended within the heater chamber 205 such that there is empty space either upstream, downstream or both, of a portion of the wick heater 204. In respect of FIG. 3, an "upstream" location is at the lower end of the consumable 150; a "downstream" location is at the upper end of the consumable 150. In use, air flow through the consumable 150 and entrained vapor/aerosol (herein referred to only as aerosol) is generally conveyed from an upstream location to a downstream location.

Upstream of the wick heater 204, there is an air inlet 164. The air inlet 164 forms an aperture into which air can flow into the heater chamber 205. Airflow may be caused by a user drawing (e.g., puffing or sucking) on the consumable 150, for example drawing on the mouthpiece 166. In some embodiments, the wick heater 204 spans across the air inlet 164. In some embodiments, the wick heater 204 is suspended above (i.e., downstream of) the air inlet 164.

Downstream of the wick heater 204, there is a heating chamber outlet 206. The heating chamber outlet 206 includes an aperture through which the aerosol from the wick heater 204 can flow from the heating chamber 205. The heating chamber outlet 206 forms an upstream opening of the outlet tube 201. The outlet tube 201 forms a passageway down which aerosol is conveyed to the mouthpiece 166 and, ultimately, to the user's mouth.

The main body 120 includes a pair of pogo pins 207. The pogo pins 207 are examples of electrical contacts. The pogo pins are 207 configured to engage directly with the wick heater 204 when the consumable 150 is engaged with the main device body 120. Electrical contact regions of the wick heater 204 are exposed at the base of the consumable 150 for direct contact with respective engagement portions of the pogo pins 207. A potential difference applied between the pogo pins 207 results in a flow of electrical current through the wick heater 204 from one electrical contact region of the wick heater 204 to the other electrical contact region of the wick heater 204. In turn, this flow of electrical current results in resistive or Ohmic heating of at least a portion of the wick heater 204 (a heating zone) between the electrical contact regions.

Each of the pogo pins 207 include an upwardly directed flat face 207*a* for co-planar engagement with the upstream surface of the wick heater 204. By co-planar it is meant that the plane of the flat face 207*a* abuts the plane of the upstream surface of the wick heater 204. The pogo pin 207 having the flat face 207*a* may increase the reliability of electrical connection between the wick heater 207 and the pogo pins 207 relative to a pointed pogo pin. In particular contact resistance between pogo pins 207 and wick heater 204 may be reduced. The flat face 207*a* may have a flat surface area of between 0.1 mm^2 and 250 mm^2. More preferably between about 3 and 40 mm^2, more preferably between about 5 and 20 mm^2.

The consumable 150 includes a downstream plate 208. In some embodiments, the downstream plate 208 is integrally formed with the outlet tube 201. This reduces the number of separate parts in the consumable 150. In turn, this reduces leakage because of a reduction in the number of component interfaces to be sealed. In the embodiment, the downstream plate 208 forms a lower sealing wall of the tank 201. Further details of the downstream plate 208 are described below.

The consumable 150 also includes an upstream plate 209. The upstream plate 209 may form a base of the consumable 150. The upstream plate 209 may be considered an example of a cover that covers at least a portion of the downstream surface of the wick heater 204.

Figure 4A:
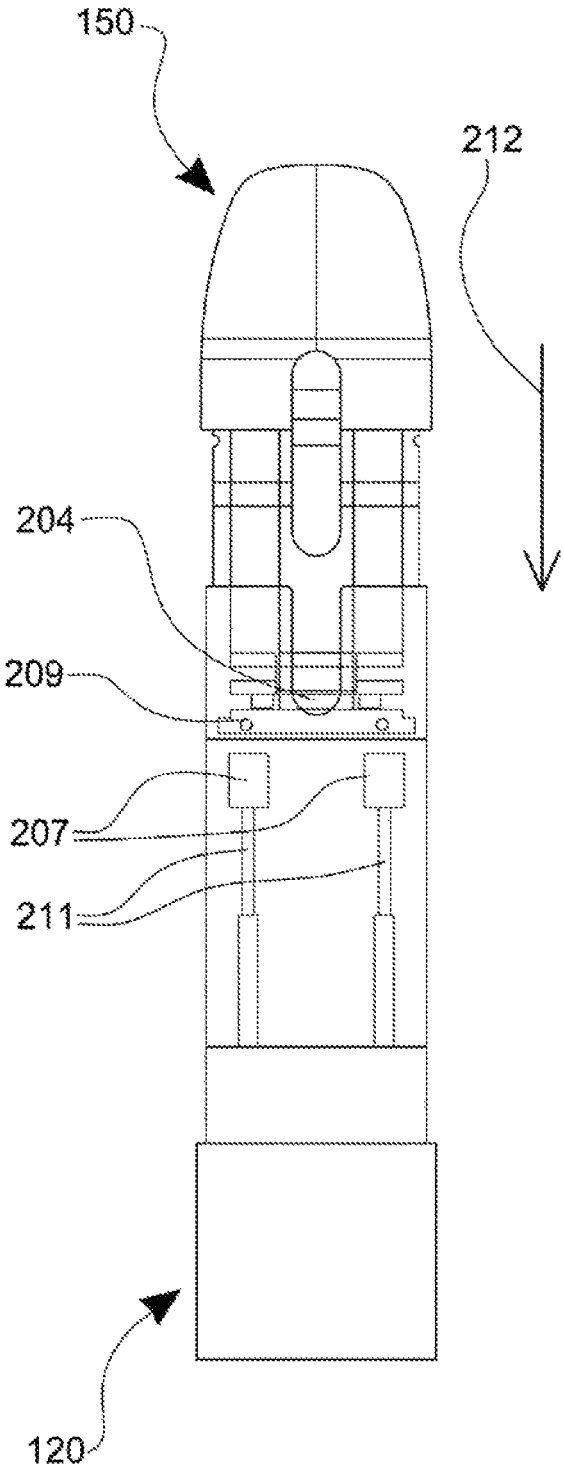
FIGS. 4A and 4B illustrate the engagement of the consumable and the main body according to an embodiment.
Figure 4B:
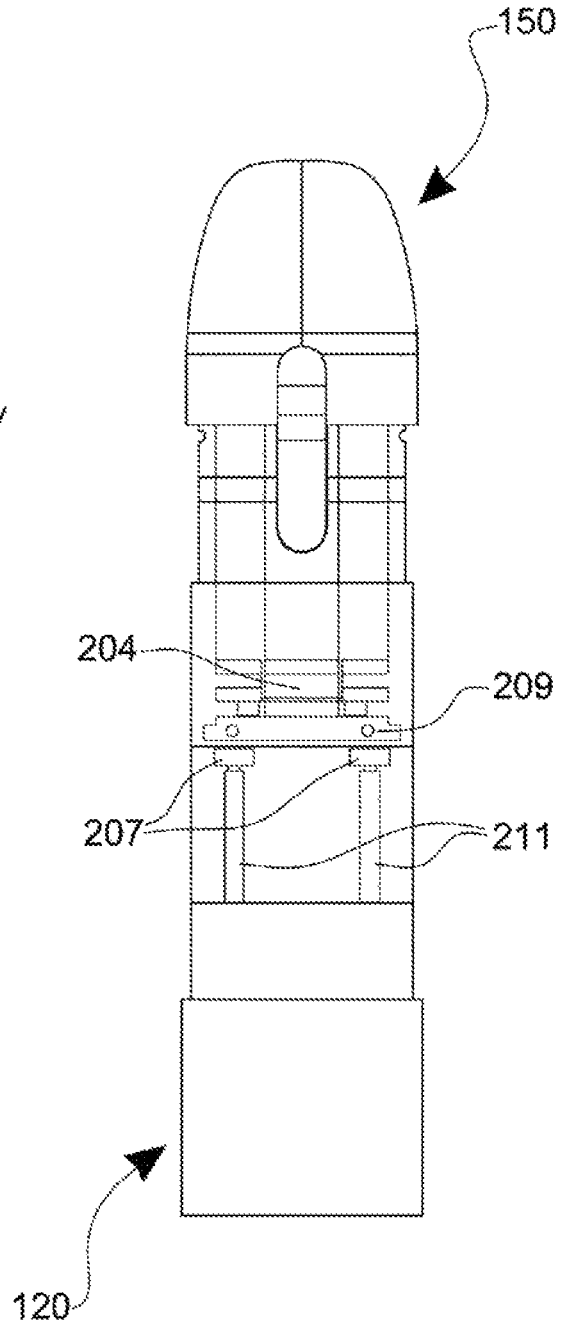

FIGS. 4A and 4B illustrate the engagement of the consumable 150 with the device 120. FIG. 4A shows the consumable 150 being brought into engagement with the device 120; FIG. 4B shows the consumable 150 having been brought into full engagement with the device 120 (and thus corresponds to FIG. 3). The pogo pins 207 are telescopically mounted via spring mounts 211 to the device 120. The pogo pins 207 are biased into the extended position shown in FIG. 4A. When the consumable 150 is engaged with the device 120 (illustrated by direction 212), the pogo pins are moved downwards by virtue of being pushed by the consumable 150. More specifically, when the consumable 150 is brought into engagement with the device 120, the distal tips of the pogo pins 207 intrude slightly into the base of the consumable 150 (through the upstream plate 209) and abut the upstream surface of the wick heater 204. The user continues to push the consumable 150 into engagement with the device 120. The upwardly biased nature of the pogo pins 207 means that the distal tips of the pogo pins 207 are retained by the biasing against the wick heater 204. This retention against the wick heater 204 may improve the reliability of the electrical connection between each pogo pin 207 and wick heater 204. For example, the biasing of the pogo pins 207 against the wick heater 204 may reduce the contact resistance between each pogo pin 207 and wick heater 204.

Figure 5A:
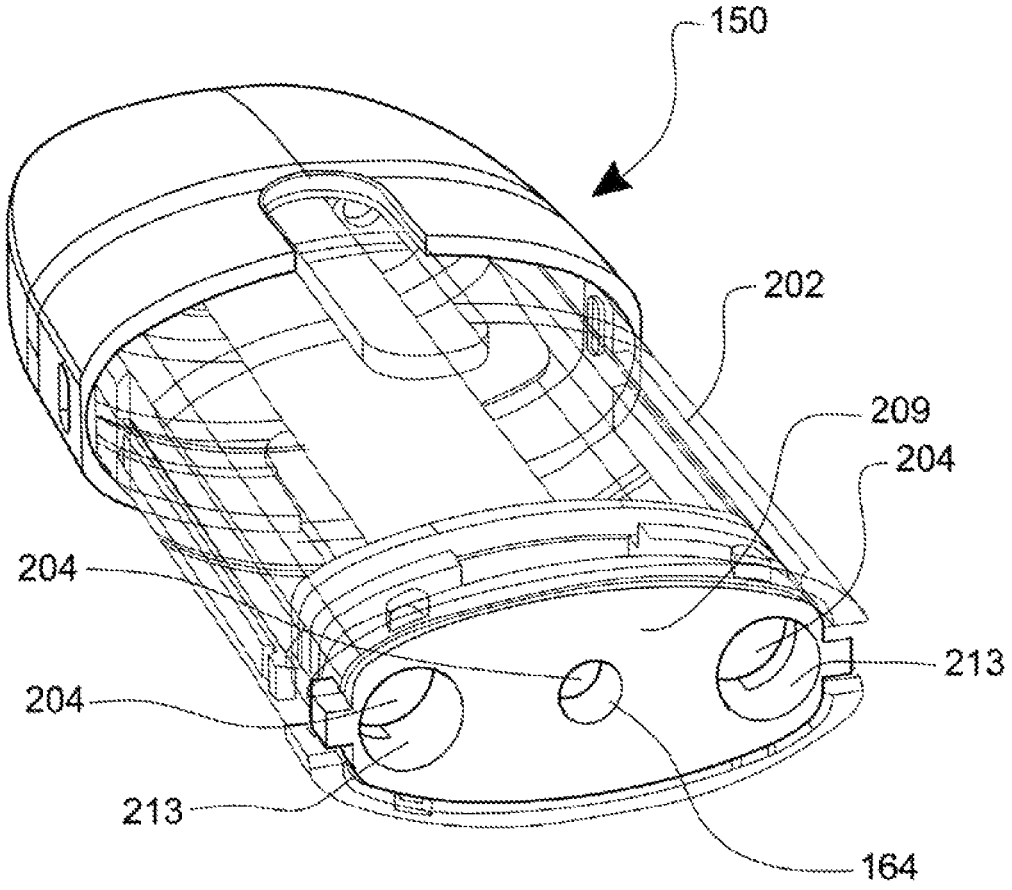
FIG. 5A is a perspective view of the consumable according to an embodiment.

FIG. 5A shows a view of the base of the consumable 150. The centrally located airflow inlet 164 is upstream of the wick heater 204, a portion of which is visible through the airflow inlet 164. In some embodiments, the consumable 150 may include a plurality of airflow inlets 164 upstream of the wick heater 204. The airflow inlet 164 is formed through the upstream plate 209, which forms a base component of the consumable 150.

Also formed through the base plate 209 are two electrical contact holes 213. The base plate 209 forms a cover. The cover, via the electrical contact holes 213, exposes the outward portions of the wick heater 204. The outward portions of the wick heater 204 are visible through the electrical contact holes 213. In use, the pogo pins 207 intrude through the electrical contact holes 213 to come into direct contact with the wick heater 204 against the outward portions of the wick heater 204. The portions of the wick heater 204 visible through the electrical contact holes 213 form the electrical contact regions. The cover also, in regions away from the air inlet 164 and the electrical contact holes 213, covers (rather than exposes) a portion of the wick heater 204.

Figure 5B:
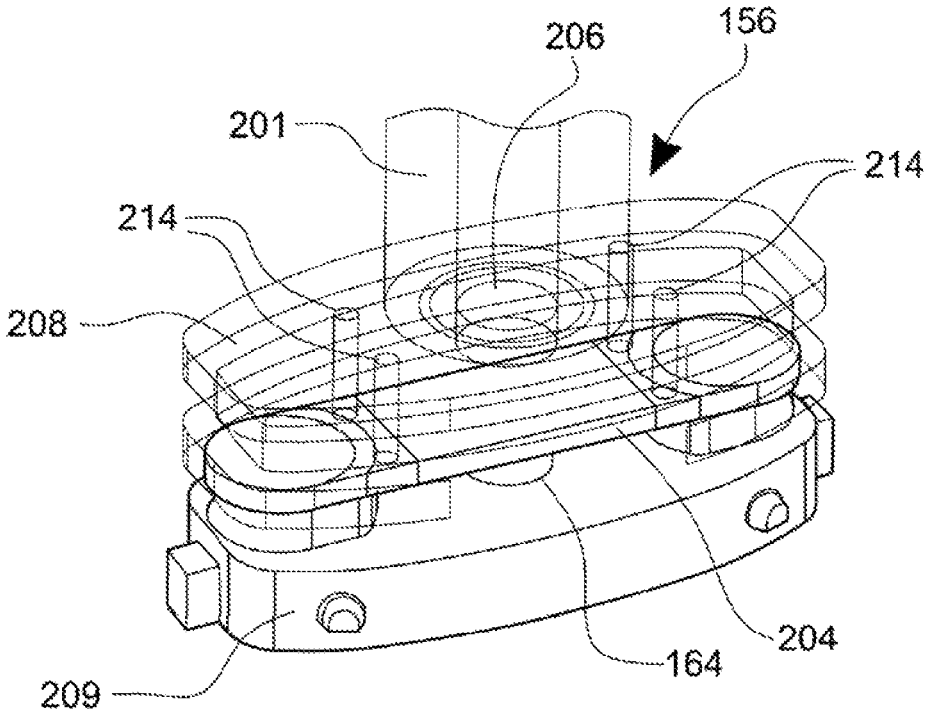
FIG. 5B is a perspective view of a portion of the consumable according to an embodiment.

FIG. 5B shows another view of the lower components of the consumable 150. The tank wall 202 (see FIG. 5A) of the consumable 150 is not illustrated. The upstream plate 209 is shown with the air inlet 164. The downstream plate 208 is shown with the integrally formed outlet tube 201 extending from a downstream surface of the downstream trap plate 208. The heating chamber outlet 206 is at the interface of outlet tube 201 and downstream trap plate 208.

Recalling FIG. 3, the tank 156 containing the e-liquid is located above the downstream plate 209, and surrounds the outlet tube 201. Returning to FIG. 5B, the downstream plate 209 includes four liquid supply passages 214 formed therethrough. The skilled person will appreciate that there may be more or fewer than four liquid supply passages 214 in a particular embodiment. At the most general the liquid supply holes 211 are a means to supply aerosol forming substrate from the tank 156 to the wick heater 204. The openings of the liquid supply passages 214 that engage the wick heater 204 constitute liquid supply locations. The liquid supply locations are offset from the heating chamber outlet 206, and in particular, laterally offset from the heating chamber outlet 206. This means that liquid is not supplied to a region of the wick heater 204 that is aligned with the heating chamber outlet 206. This may reduce a propensity for liquid to be directly (i.e., without vaporization) carried off the wick heater 204 by airflow through the device 150. Such liquid may ultimately exit from the mouthpiece of the device as undesirable leakage of unvaporized liquid into the user's mouth, which is to be avoided.

At the most general, each liquid supply passage 214 extends between the supply of aerosol forming substrate (e.g., e-liquid in the tank 156) and the wick heater 204. E-liquid is conveyed from the tank 156 to the wick heater 204 along each liquid supply passage 214 via capillary action. Each liquid supply passage 214 forms a capillary channel. As e-liquid is vaporized from the wick heater 204 it is replenished with e-liquid, via the liquid supply passages 214, from the tank 156. If the liquid flow rate along the liquid supply passages 214 is too high may occur; if the liquid flow rate along the liquid supply passages 214 is too low, then vaporization performance may be diminished. By controlling the number and dimensions of the liquid supply passages 214 (e.g., cross sectional shape, cross sectional dimensions, and/or length) the supply of liquid to the wick heater 204 can be accurately controlled. Because the number and dimensions of the liquid supply passages 214 may be accurately controlled during the manufacturing process of the consumable 150, variability between consumables in liquid supply rate can be minimized.

In some embodiments, the downstream plate 208 may be formed from a polymeric material, which may be easy to form the liquid supply passages 214 therethrough (e.g., via injection molding). This may be an improvement on a coil and wick heater arrangement, in which there may be significant variability in at least the liquid supply rate of the wick in a coil and wick arrangement. This may be due to variability in the properties of the wick in a coil and wick arrangement.

The typical length of the liquid supply passages 214 may be between 1.0 and 5.0 millimeters. The length of the liquid supply passages 214 may be substantially equal to the depth of the downstream plate 208.

The typical opening size (e.g., the diameter of a circular cross sectional shape liquid supply passage 214) may be between 0.1 and 1.0 millimeters. Where the liquid supply passage is not circular, the maximum dimension of the cross-sectional shape of the liquid supply passage 214 may between 0.1 and 1.0 millimeters.

In some embodiments, the liquid is supplied to the wick heater 204 along a supply direction that is perpendicular to the plane of the wick heater 204. The liquid supply passages 214 are an example of such an arrangement. This may allow for more efficient delivery of liquid to the wick heater 204. In some embodiments, the liquid is supplied to the wick heater 204 along a supply direction that is perpendicular to the plane of the downstream plate 208. Liquid supply passages 214 that are perpendicular to the plane of the downstream plate 208 may also be easier to produce, e.g., via molding of polymeric materials. In some embodiments, the liquid is supplied to the wick heater 204 along a supply direction that is parallel to the longitudinal axis of the outlet tube 201. Liquid supply passages 214 that are parallel to the longitudinal axis of the outlet tube 201 may also be easier to produce, e.g., via molding of polymeric material. In some embodiments, the liquid is supplied along a supply direction that is parallel to a longitudinal axis of the consumable 150 (i.e., the long axis extending between generally upstream and downstream locations).

The number, dimensions, and shapes of the liquid supply passages 214 that are selected in a particular consumable 150 may depend on a viscosity of the aerosol forming substrate in the tank 156. In some embodiments, the aerosol forming substrate in the tank 156 may have a viscosity of between 100 and 300 centistokes (mm^2/s). The dimensions of the capillary channels 214 described above may be particular useful for supply of liquid having such a viscosity at an appropriate supply rate. A family of consumables 150 may have different configurations of liquid supply passages 214 depending on the viscosity of the liquid to be held in the consumables.

In some embodiments, the tank 156 is otherwise sealed to the atmosphere—only the liquid supply passages 214 form an opening between the atmosphere and the inside of the tank 156. As liquid is used from within the tank 156, the pressure within the tank 156 must equalize with the atmosphere. In many prior art examples, this equalization takes place via a flow of air from the atmosphere, through the wick, and into the tank. As above, the parameters of the wick are often variable, and the reliability of pressure equalization is often low. In the present embodiments, pressure equalization may take place via a flow of air from the atmosphere, through the liquid supply holes 214, and into the tank 156.

Similar to the improved reliability of the supply of liquid, the fact that liquid supply holes may be made with accurate manufacturing tolerances may improve the reliability of pressure equalization. This, in turn, may improve the reliability of liquid flow from the tank by reducing the chance of a mismatch between atmospheric pressure and pressure in the tank 156, which may otherwise cause a reduced flow of liquid from the tank 156.

The wick heater 204 spans the airflow inlet 164. However, as shown, the wick heater 204 does not completely obscure or cover the airflow inlet 164. In some embodiments, the wick heater 204 is suspended above the airflow inlet 164. Airflow in the heating chamber may flow around at least one of the transverse edges of the wick heater 204. Airflow is important for the effective vaporization of the e-liquid from the wick heater 204.

Figure 5C:
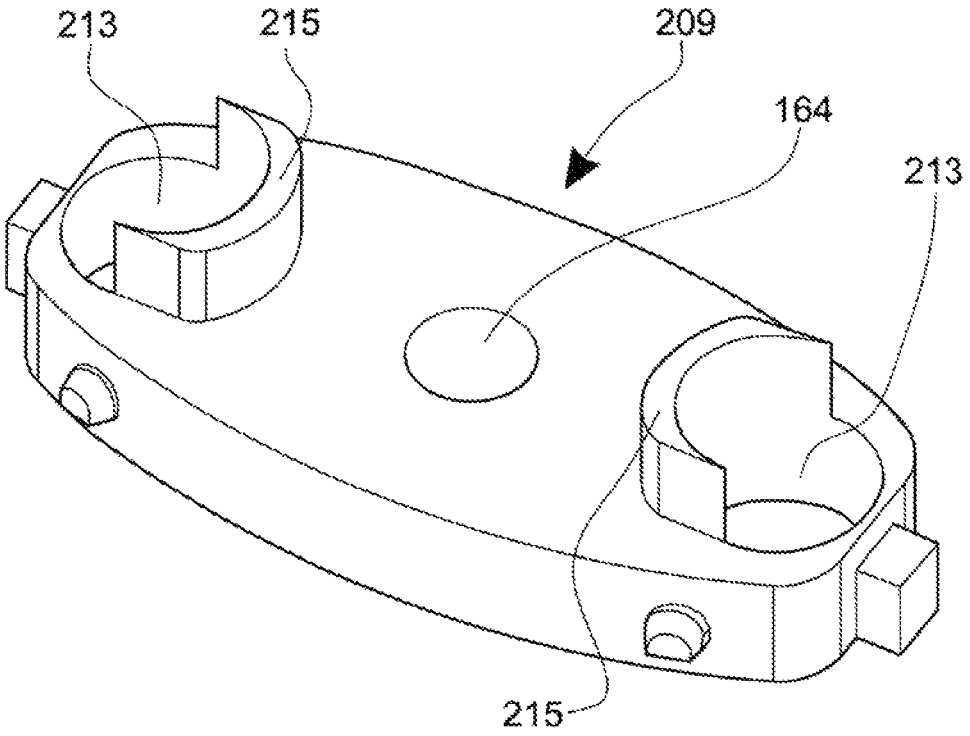
FIG. 5C is a perspective view of a portion of the consumable according to an embodiment.

FIG. 5C shows the upstream plate 209 alone. The centrally located airflow inlet 164 is formed through the upstream plate 209. The electrical contact holes 213 are located laterally outward either side of the airflow inlet 164. Inward of each respective electrical contact hole 213 is a wick trap gasket 215. Each wick trap gasket 215 is located between the airflow inlet 164 and a respective electrical contact hole 213.

During manufacture of the consumable 150, when the downstream plate 208 is moved towards the upstream plate 209 (with the wick heater 204 located therebetween) the wick trap gaskets 215 contact the wick heater 204 on the upstream surface of the wick heater 204. As the downstream plate 208 is moved further towards the upstream plate 209, the wick heater 204 is compressed between the wick trap gaskets 215 and the downstream plate 208. By compressing the wick heater 204 in those regions, liquid flow rate along the wick heater 204 through the compression point formed by the gasket 215 and downstream trap plate 208 The gaskets 215 form a pair of barrier regions in the wick heart 204. The reduction in liquid flow rate at the barrier region may be lower relative to a liquid flow rate in the wick heater 204 outside the barrier region. For example, the liquid flow rate at the gasket 215 may be lower than the liquid flow rate in a central heating zone of the wick heater 204.

In some embodiments, the reduction in liquid flow rate through the wick heater 204 happens because the porosity of the wick heater 204 in the compressed region may be significantly reduced relative to the rest of the wick heater 204, and in particular between wick trap gaskets 215. The wick trap gaskets reducing the wicking propensity of the wick heater 204 in the compressed region. However, since the electrical conductivity of the wick heater 204 is not significantly affected by the compression of the wick heater 204, current flow through the wick heater 204 is also not significantly affected by the compression. By locating the electrical connection points (effectively designated in FIG. 5C by the electrical contact holes 213) laterally outward of the gaskets 215, liquid leakage out from the consumable 150 via the electrical contact holes 213 may be reduced while effective and reliable electrical conduction through the wick heater 204 is maintained.

In some embodiments, alternative methods of reducing liquid flow rate in the barrier regions may be used. Compression of the wick heater 204 is not the only mechanism to do so.

FIG. 5C shows the gaskets 215 formed as downstream pointing projections from the upstream plate 209. In some embodiments, the gaskets 215 may be formed as upstream pointing projections from the downstream plate 208. In some embodiments, the gaskets 215 may include downstream pointing projections from the upstream plate 209 and upstream pointing projections from the downstream plate 208. In such embodiments the upstream pointing projections and downstream pointing projections may be configured to mutually align with one another to compress the wick between opposing pairs of upstream and downstream pointing gaskets.

In some embodiments, and as illustrated in FIG. 5C, each gasket 215 may be formed from a non-straight wall, e.g., a curved wall. The curved gaskets 215 may be arranged such that a concave side of the curved gasket 215 faces towards the electrical contact regions 216. This may increase the area of the wick heater 204 that is available for e-liquid retention relative to the same wick heater in a consumable having straight walled gasket.

Figure 6:
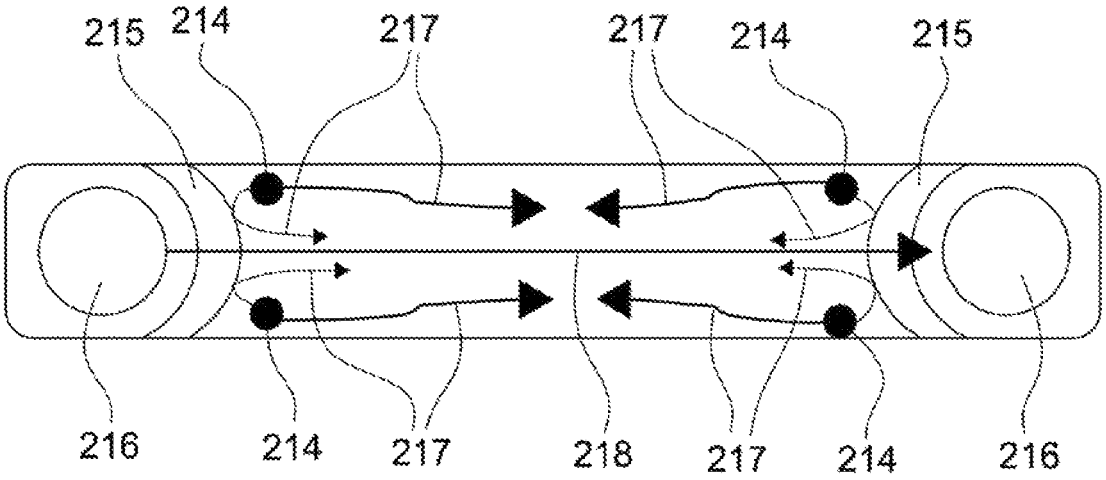
FIG. 6 is a schematic of a portion of the consumable according to an embodiment.

FIG. 6 shows a schematic representation of the wick heater 204 of an embodiment. The pogo pins 207 contact the wick heater 204 at the electrical contact regions 216, which are accessed via the electrical contact holes 213 in the upstream plate 209. A centrally located heating zone is located electrically between the electrical contact regions 216. The locations of the gaskets 215 are also shown. The e-liquid is supplied to the wick heater 204 via the liquid supply passages 214. Example liquid flow from the liquid supply passages 214 is indicated by arrows 217. The gaskets 215 are located longitudinally inside the electrical contact regions 216. The liquid supply passages 214 are located longitudinally inside the gaskets 215. As such, the barrier regions formed by the gaskets 215 inhibit liquid flow towards the electrical contact regions, and promote liquid retention in the heating zone. In particular, the barrier regions formed by the gaskets 215 may substantially prevent liquid from flowing through the wick heater 204 (across the barrier regions) to the electrical contact regions 216. Keeping liquid away from the electrical contact regions 216 is desirable to cleanliness of the electrical contact regions 216 and the reduction of leakage of the liquid from the consumable. Keeping liquid in the heating zone leads to efficient heating and vaporization of the liquid from the heating zone.

As described above, the compression of the wick heater 204 caused by the gaskets 215 substantially prevents liquid flow to the electrical contact regions 216. Liquid flow is substantially constrained within the wick heater 204 between the gaskets 215. The liquid flow within the wick heater 204 may be preferentially towards the central region of the wick heater 204, which may improve the performance of the consumable 150, for example by increasing the vapor output from the consumable 150.

As described above, the compression of the wick heater 204 caused by the gaskets 215 does not prevent electrical conduction of the wick heater 204, which is represented by the arrow 218. The electrical current 218 flows from one electrical contact region 216 to the other electrical contact region 216 substantially unimpeded by the compression of the wick heater 204 caused by the gaskets 215. A centrally located heating portion of the wick heater 204 is formed, which is electrically between the electrical contact regions 216.

In some embodiments, the liquid flow rate in the rate across or through the barrier region may be less than 80% of the liquid flow rate outside the barrier region, preferably less than 60%, more preferably less than 40%, more preferably less than 20%, more preferably less than 10%, more preferably less than 5%. The liquid flow rate outside the barrier region may be an average liquid flow rate along the long axis of the wick heater 204 between the barrier regions.

In some embodiments, the reduction in liquid flow rate is achieved by reducing the porosity of the wick heater 204 in the barrier regions. The porosity of the wick heater 204 in the barrier regions may be less than 80% of the porosity of the wick heater 204 outside the barrier region, preferably less than 60%, more preferably less than 40%, more preferably less than 20%, more preferably less than 10%, more preferably less than 5%.

In some embodiments, the reduction in porosity is achieved by reducing depth of the wick heater 204 in the barrier region. The reduced depth of the wick heater in the barrier region may be less than 80% of the depth of the wick heater 204 outside the barrier region, preferably less than 60%, more preferably less than 40%, more preferably less than 20%, more preferably less than 10%, more preferably less than 5%. The depth of the wick heater 204 outside the barrier region may be an average depth of the wick heater 204 between the barrier regions.

The barrier porosity of the wick heater 204 in the barrier region may be at least 3 times lower than the wick porosity of the wick heater 204 outside the barrier region, preferably at least 7 times lower, more preferably at least 10 times lower. For example, the wick porosity outside the barrier region may be an average porosity of the wick heater 204 between the barrier regions.

Figure 7:
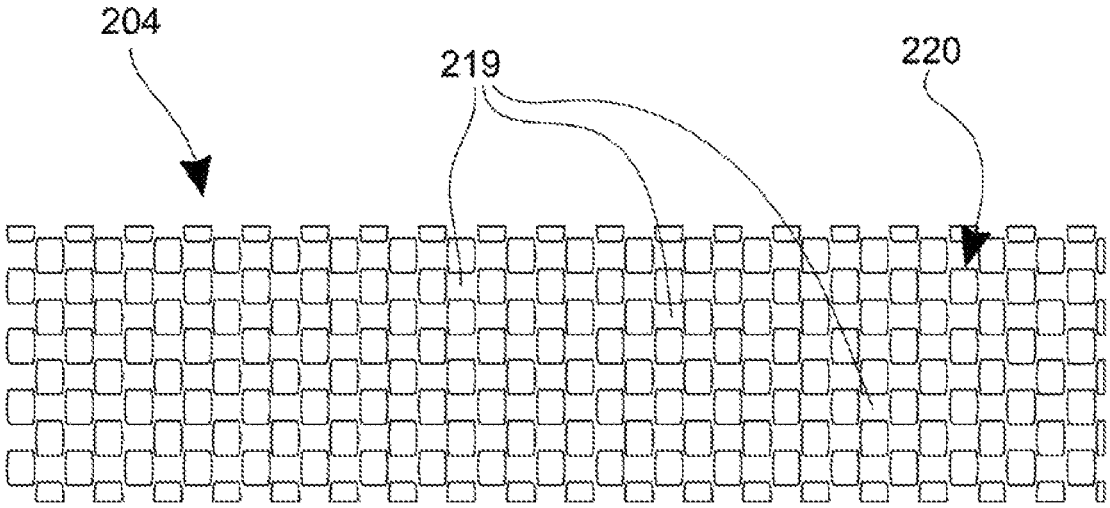
FIG. 7 is a view of a wick heater of the consumable according to an embodiment.

FIG. 7 shows an example fabric 220 for the wick heater 204 according to the present disclosure. The interstices 219 between the yarns constituting the fabric 220, and the interstices between the fibers constituting the yarns, provide locations for e-liquid retention and conveyance and result in the fabric being "porous". In some embodiments, and as shown in FIG. 7, the fabric 220 is a woven fabric. The weave type may be a plain weave. The warp density may be between 1 and 20 per cm. More preferably between 5 and 15 per cm. more preferably between 8 and 12 per cm. The weft density may be between 1 and 20 per cm. More preferably between 5 and 15 per cm. More preferably between 8 and 12 per cm. In some embodiments the warp density is equal to the weft density.

In some embodiments, the fabric may be a non-woven fabric.

In some embodiments, the wick heater 204 is formed from a planar sheet of fabric. Such wick heaters 204 may be simple to manufacturer by cutting/stamping individual wick heaters 204 from a larger sheet of the fabric 220.

The fabric 220 may have a thickness of between 100 and 1000 microns. More preferable between 200 and 800 microns. More preferably between 300 and 600 microns. More preferably between 300 and 500 microns. More preferably between 400 and 500 microns.

The fabric 220 may have a carbon content of greater than 50%. More preferably greater than 60%. More preferably greater than 70%. More preferably greater than 80%. More preferably greater than 90%. More preferably greater than 95%. More preferably greater than 99%.

The fabric 220 may have been treated to increase hydrophilicity. For example, the fabric 220 may include a hydrophilic coating. This may improve the wetting properties of the fabric 220, which may in turn increase a propensity of the fabric 220 to retain and convey e-liquid.

The fabric 220 may have an area density of between 0.005 and 0.03 grams per $cm^2$. More preferably between 0.010 and 0.02 grams per $cm^2$. More preferably between 0.011 and 0.015 grams per $cm^2$.

A suitable example fabric is the "ELAT Hydrophilic" material available from Nuvant®.

The fabric 220 may have a porosity of between 40 and 95%. More preferably between 50 and 90%. More preferably between 60 and 90%. More preferably between 70 and 90%. More preferably substantially 80%.

The electrical sheet resistance of the fabric 220 may be between 0.5 and 3.0 ohms per square. More preferably, the electrical sheet resistance of the fabric 220 may be between 0.5 and 2.0 ohms per square. More preferably, the electrical sheet resistance of the fabric 220 may be between 0.5 and 1.5 ohms per square. More preferably, the electrical sheet resistance of the fabric 220 may be between 0.8 and 1.3 ohms per square. More preferably, the electrical sheet resistance of the fabric 220 may be substantially equal to 1.1 ohms per square.

The electrical resistance of the wick heater 204 as a whole may be any value suitable for use as a heater for an e-cigarette. For example, the resistance of the wick heater 204 may between 0.1 and 3 ohms. More preferably between 0.5 and 2 ohms. More preferably between 1 and 2 ohms. It will be appreciated that the dimensions and shape of the wick heater 204 will affect the electrical resistance value.

Figure 8A:
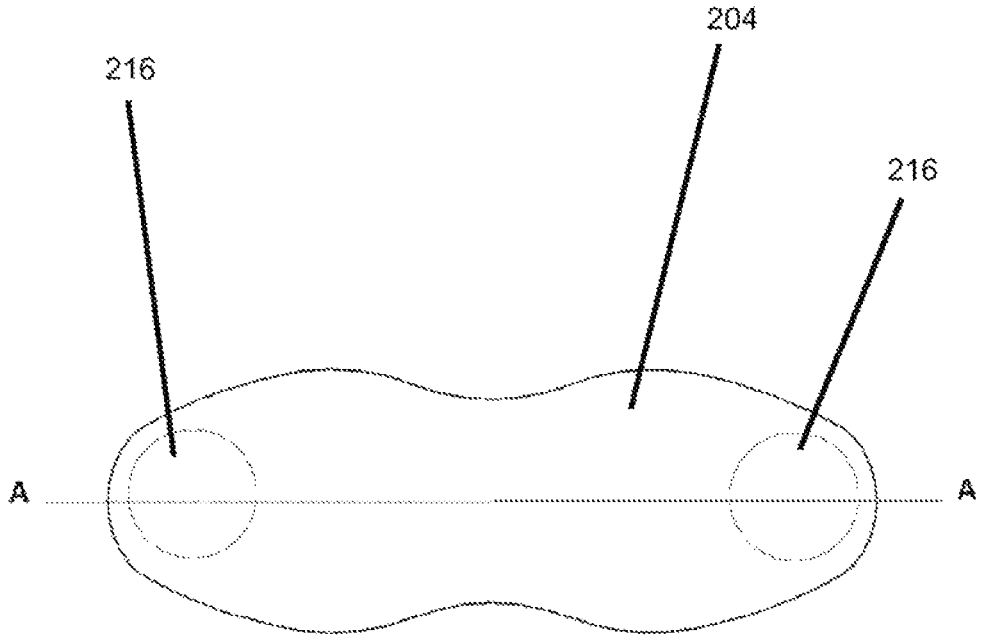
FIGS. 8A and 8B are a plan view and a cross section of a wick heater according to an embodiment.

FIG. 8A shows a view of the lower surface of the wick heater 204. The wick heater 204 includes the two electrical connections regions 216. The electrical connection regions 216 are located towards opposing ends of the generally elongate wick heater 204.

Figure 8B:
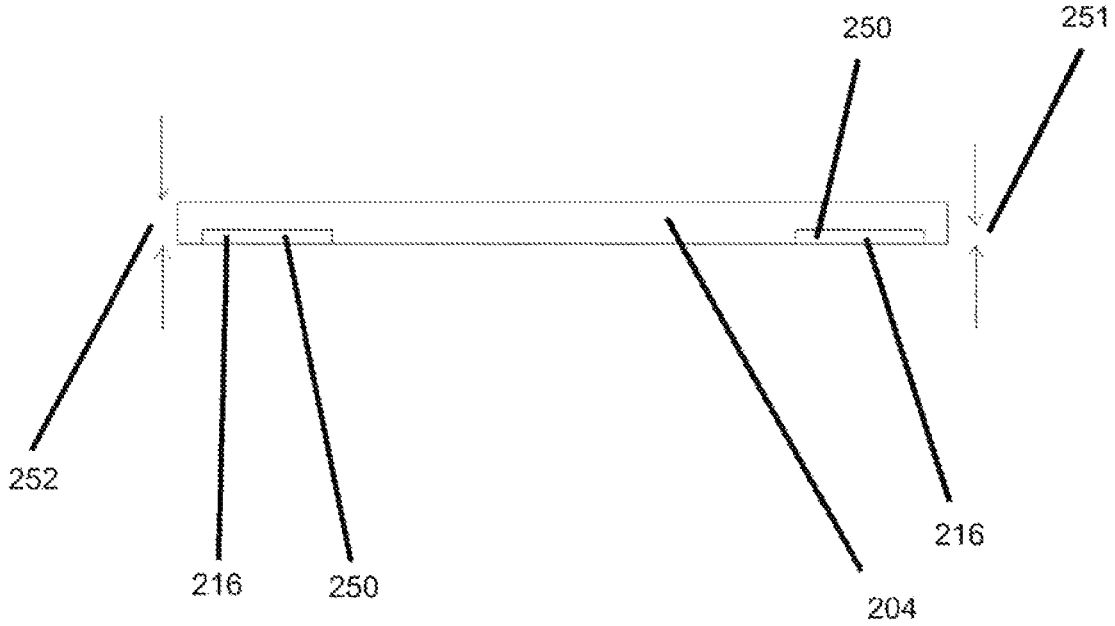

FIG. 8B shows a cross section of the wick heater 204 through line A-A as shown in FIG. 8A. The electrical connection regions 216 are shown. The electrical connection regions 216 include an electrically conductive additive, which may include a metal (e.g., silver, gold or any metal with a high electrical conductivity). A silver containing paste is an example of electrically conductive additive 250. The additive substantially fills interstices between the yarns and fibers of the wick heater 204 in the electrical connection region 216. The electrically conductive additive 250 may cover only a portion of the total surface area of the wick heater 204. The electrical connections regions 216 are separate from one another in the sense that there is no electrically conductive additive applied in a region between the electrical connection regions 216.

As far as the liquidity of the electrically conductive additive 250 is concerned, it is sufficient that the additive is liquid enough to intrude into the interstices of the wick heater 204 when applied to the wick heater 204. Example electrically conductive additives includes liquids, pastes and gels.

The wick heater 204 is made according to the following method:

The woven, electrically conductive, wick heater 204 is provided.

The electrically conductive additive 250 is applied to the lower surface of the wick heater 204 in the electrical connection regions 216. The electrically conductive additive 250 may be painted or printed on to the wick heater 204, for examples. The electrically conductive additive 250 may alternatively be applied in chemical vapor deposition process.

The electrically conductive additive 250 permeates into the interstices between the yarns of the fabric of the wick heater 204, and into the interstices between the fibers that make up the yarns themselves. It is not a requirement of the present disclosure that both types of permeation take place; one type of permeation is sufficient. The electrically conductive additive 250 penetrates the wick heater 204 in the depth dimension to a penetration depth 251. The penetration depth 251 may be smaller than a total depth 252 of the wick heater 204.

An amount and distribution of electrically conductive additive 250 applied to the lower surface of the wick heater 204 may define the penetration depth 251 and the portion of the lower surface that is covered by the electrically conductive additive 250. Consequently, the size and shape of the electrical connection region 216 may be defined.

In some embodiments, the electrically conductive additive 250 is flattened on the lower surface of the wick heater 204 in the electrical connection regions 216. Therefore, in such embodiments, the electrical connection region 216 includes a flat lower surface. The flattening step may be part of the application step, i.e., the application may naturally result in the flat surface of the electrically conductive additive. Alternatively, there may be a distinct step flattening process, for example the pressing of a flat surface against the electrically conductive additive 250 prior to hardening.

The electrically conductive additive 250 is hardened (which may occur naturally, or may be through a specific process, e.g., baking or heating or cooling). It is noted that the electrical conductivity property of the electrically conductive additive 250 is only required in the final wick heater 204. Because of that, it is not a requirement that the electrically conductive additive 250 is electrically conductive prior to the completion of the manufacture of the wick heater 204. For example, in its liquid form, the electrically conductive additive 250 may not be electrically conductive, but when hardened it is electrically conductive.

What results is an electrical connection region 216 of the wick heater 204 that provides for an electrically conductive connection between the wick heater 204 (specifically the yarns and the fibers) and the electrically conductive additive 250. By electrically connecting a power supply to the electrically conductive additive 250 (at the electrical connection region 216) a reliable electrical connection, with a predictable resistance, can be achieved between the power supply and the wick heater 204. Such a reliable connection may be relatively difficult to achieve with direct electrical connection to a heater.

The electrical sheet resistance of the electrically conductive additive 250 may be between 0.01 and 1.0 ohms per square. More preferably, the electrical sheet resistance of the electrically conductive additive 250 may be between 0.1 and 0.5 ohms per square. More preferably, the electrical sheet resistance of the electrically conductive additive 250 may be between 0.1 and 0.3 ohms per square.

Figure 9A:
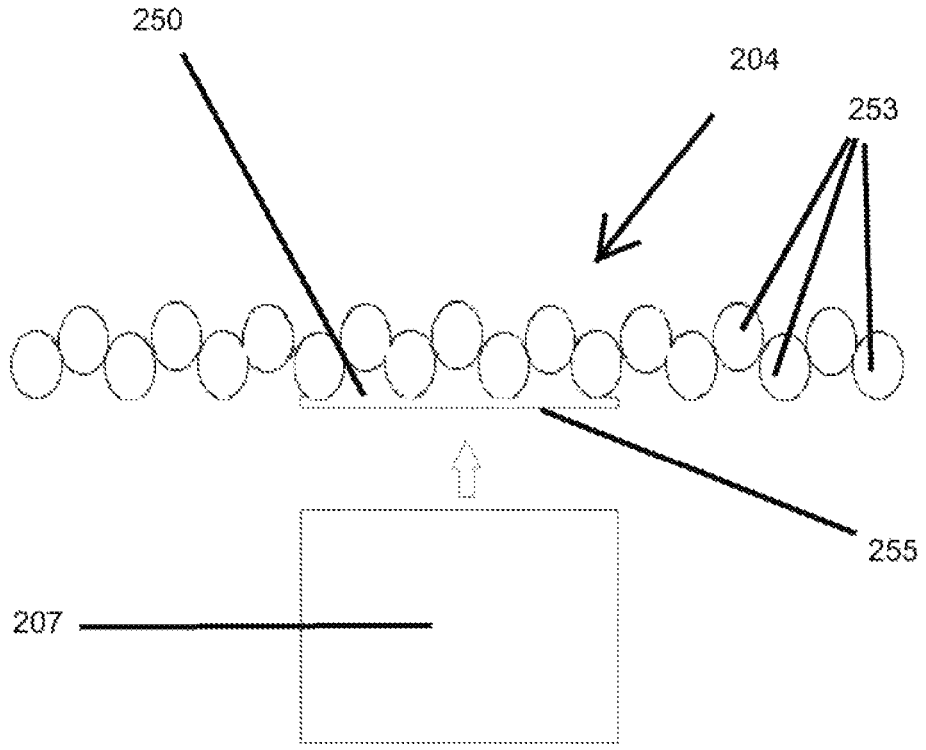
FIGS. 9A and 9B are cross sections through wick heater according to an embodiment.
Figure 9B:
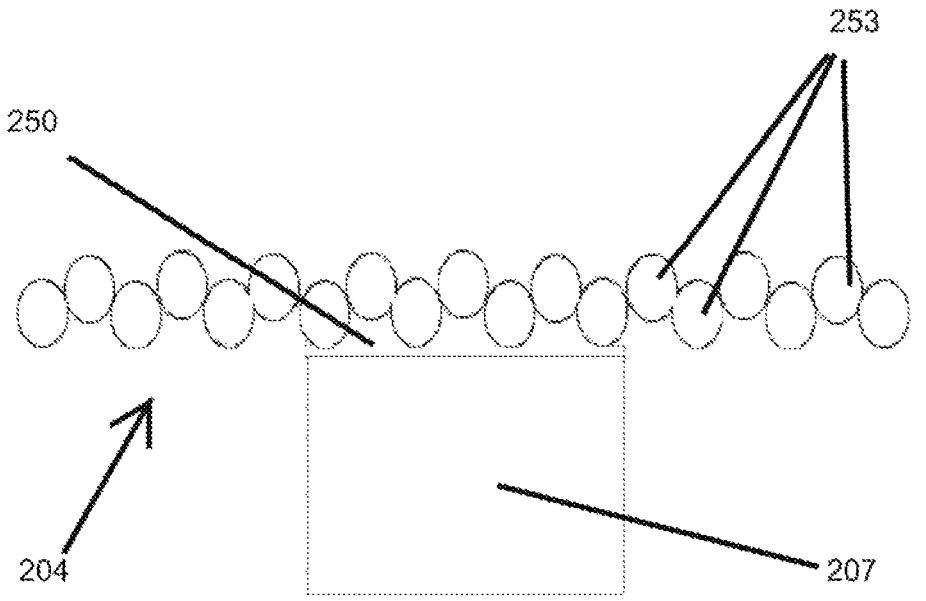

FIGS. 9A and 9B show a cross section through a portion of a wick heater 204 in accordance with the present disclosure. The cross section shows a number of the warps 253 (or wefts) of the fabric of the wick heater 204. The electrically conductive additive 250 is shown filling a lower portion of the interstices between the warps 253 of the wick heater 204. The electrically conductive additive 250 also intrudes into, and may substantially fill, the interstices between the fibers comprised in each yarn (e.g., warps 253). The lower surface 255 of the electrically conductive additive 250 has been flattened during the manufacturing process. This permits a reliable electrical connection with an electrical connector in a main device. The electrical connector is the pogo pin 207 (see FIG. 3), which is illustrated separated from the electrically conductive additive 250 in FIG. 9A and engaged with the hardened paste 250 in FIG. 9B. The pogo pin 207 may also include a substantially flat electrical connection surface for engagement with the electrically conductive additive 250.

Figure 10:
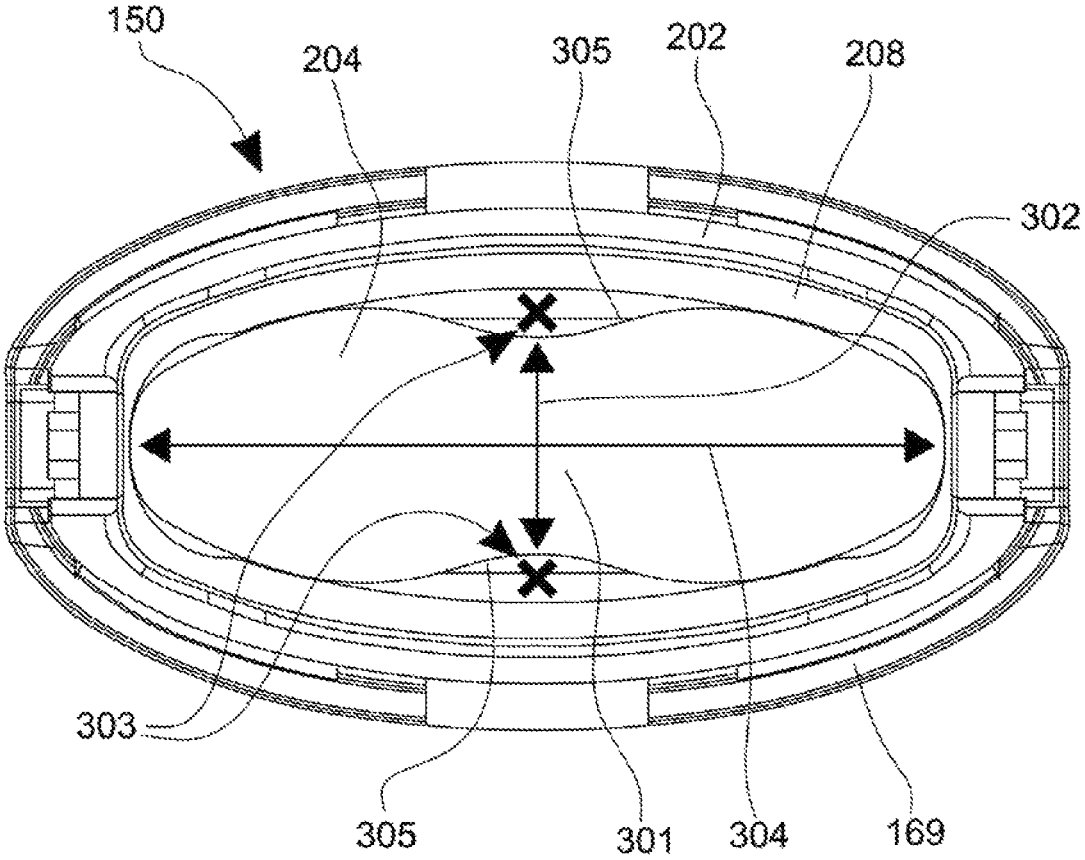
FIG. 10 is a view of the base of a portion of the consumable according to an embodiment.

FIG. 10 shows another embodiment of the wick heater 204. The view of FIG. 10 is viewed from downstream and below the consumable 150. The upstream plate 209 is absent in FIG. 10 so that the wick heater 204 is visible. The downstream plate 208 is visible around the periphery of the wick heater 204.

The wick heater 204 has a lateral narrowing 301 in the plane in a central region of the wick heater 204. The narrowing 301 may be located in the heating chamber 205 (see FIG. 3) of the consumable 150. The narrowing 301 of the wick heater 204 may increase the local electrical resistivity of the wick heater 204 at the narrowing 301. This may result in a higher heater temperature in use in the lateral narrowing 301. Having the higher heater temperature located away from the compression points caused by the gaskets 215 may be advantageous since heating of the other material of the consumable 150 may be minimized. The in-plane (of the wick heater 204) width 302 of the narrowing may be between 1 and 6 mm. more preferably between 2 and 5 mm. More preferably between 2.5 and 3.5 mm.

The narrowing 301 is formed by two opposing convex (relative to one another) cut outs 305 in the transverse sides of the wick heater 204. The radius of curvature of each convex cut out 305 may be between 2 and 50 mm, preferably between 2 and 10 mm, more preferably between 1 and 6 mm. In the embodiment of FIG. 10 the cut outs 305 have a radius of curvature of substantially 3.8 mm.

In some embodiments, the wick heater 204 is symmetrical along a longitudinal axis of symmetry. Additionally, or alternatively, in some embodiments the wick heater 204 is symmetrical along a transverse axis of symmetry. In each case, such symmetry may improve the ease of manufacture of the device since the wick heater 204 is agnostic to a certain degree to the orientation in which it is located in the device.

The narrowing 301 of the wick heater 204 may also provide for airflow passages 303 (generally represented by the location of the "X"'s in FIG. 10). The airflow passages 303 form a route for airflow that passes around the cut outs 305 on the transverse sides of the wick heater 204 around the narrowing 301, which is where vaporization may be preferentially taking place because of the increase resistivity at the narrowing 301. This may improve the efficiency of vaporization from the wick heater 204.

The longitudinal length 304 of the wick heater 204 may be between 10 and 30 mm. More preferably between 10 and 25 mm. More preferably between 10 and 15 mm. More preferably between 12 and 14 mm.

It will be appreciated that the size and shape of wick heater 204 may be at least partially constrained by the size and shape of the consumable 150 in which the wick heater 204 is located.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

Illustrative Embodiments

Further aspects of the disclosure are set out in the following numbered clauses.

A1. A smoking substitute device including:

an electrically conductive porous wick heater;

a store for containing aerosol forming substrate;

a transfer member configured to convey aerosol forming substrate from the store to the wick heater, wherein the transfer member includes at least one capillary channel extending between the store and the wick heater; and wherein the transfer member is configured to supply, along the at least one capillary channel, aerosol forming substrate from the store to the wick heater.

A2. A smoking substitute device according to A1, wherein the wick heater is substantially planar.

A3. A smoking substitute device according to A2, wherein the wick heater includes an electrically conductive fabric.

A4. A smoking substitute device according to any of A1-A3, wherein the wick heater includes carbon fibers.

A5. A smoking substitute device according to any of A1-A4, wherein at least a portion of the wick heater is hydrophilic.

A6. A smoking substitute device according to A5, wherein the wick heater includes a hydrophilic coating.

A7. A smoking substitute device according to any of A1-A6, wherein a respective outlet of the at least one capillary channel is located adjacent the wick heater at a respective feed location, wherein each respective feed location is located between a first electrical connection region of the wick heater and a second electrical connection region of the wick heater.

A8. A smoking substitute device according to any of A1-A8, wherein a channel diameter of the at least one capillary channel is between 0.1 mm and 1.0 mm.

A9. A smoking substitute device according to any of A1-A8, wherein a channel length of the at least one capillary channel is between 1.0 mm and 5.0 mm.

A10. A smoking substitute device according to any of A1-A9, wherein the store includes a liquid aerosol forming substrate, and optionally, wherein the liquid aerosol forming substrate has a viscosity between 100 and 300 centistokes.

A11. A smoking substitute device according to any of A1-A10, wherein a portion of the wick heater is located within a heating chamber of the substitute smoking device, the heating chamber having an aerosol outlet leading to a device outlet of the smoking substitute device, wherein the at least one capillary channel includes at least one first capillary channel on a first side of the aerosol outlet and at least one second capillary channel on a second, opposite, side of the aerosol outlet.

A12. A smoking substitute device according to any of A1-A11, wherein the at least one capillary channel is substantially parallel to a longitudinal axis of the smoking substitute device.

A13. A smoking substitute device according to any one of A2 to A12, wherein a plane of the planar wick heater is perpendicular to a longitudinal axis of the smoking substitute device.

A14. A smoking substitute device according to any of A1-A13, wherein the transfer member is formed from a non-porous material.

A15. A smoking substitute system including:

a smoking substitute device according to any of A1-A14; and a main body, wherein the smoking substitute device and main body are configured be mutually engaged such that electrical power may be supplied from the main body to the wick heater.

B1. A smoking substitute device including:

an electrically conductive porous wick heater located in a vaporization chamber, the vaporization chamber having a vapor outlet for conveying vapor to a device outlet of the device;

a store for containing aerosol forming substrate for supply to the wick heater;

a transfer member configured to supply the aerosol forming substrate to at least one feed location on the wick heater, wherein the at least one feed location is located between a first electrical connection region of the wick heater and a second electrical connection region of the wick heater and wherein the at least one feed location is offset from the vapor outlet.

B2. A smoking substitute device according to B1, wherein the at least one feed location includes a first and second feed location.

B3. A smoking substitute device according to B2, wherein the first feed location is located on an opposing side of the vapor outlet to the second feed location.

B4. A smoking substitute device according to any of B1-B3, wherein the wick heater includes an electrically conductive fabric.

B5. A smoking substitute device according to B4, wherein the electrically conductive fabric is woven.

B6. A smoking substitute device according to any of B1-B5, wherein the wick heater is substantially planar.

B7. A smoking substitute device according to B 6, wherein the at least one feed location is a located on an upper surface of the substantially planar wick heater.

B8. A smoking substitute device according to B 7, wherein the first and second electrical connection regions are located on a lower surface of the planar wick heater, opposite to the upper surface.

B9. A smoking substitute device according to any of B1-B8, wherein the transfer member includes at least one capillary passage, and wherein each of the at least one feed location corresponds to an end of a respective capillary passage.

B10. A smoking substitute device according to B9, wherein each of the at least one capillary passages extends between the store and the wick, passing through the transfer member.

B11. A smoking substitute device according to any of B1-B10, wherein the aerosol forming substrate has a viscosity of between 100 and 300 centistokes.

B12. A smoking substitute device according to any of B1-B10, wherein the wick heater includes at least one barrier region of a reduced porosity.

B13. A smoking substitute device according to B12, wherein the at least one barrier region is located between one of the first and second electrical connection regions and one of the at least one feed location.

B14. A smoking substitute device according to B12 or B13, wherein the barrier region has a lower wick porosity at the barrier region and the wick heater has a higher wick porosity outside the barrier region.

B15. A smoking substitute system, including a substitute smoking device according to any of B1-B14, and further including a main body device, wherein the main body is configured to supply electrical current between the first and second electrical connection regions.

C1. A method of manufacture of a heater for a smoking substitute device including the steps of:

providing an electrically conductive porous wick heater;

applying an electrically conductive additive to at least an electrical connection region of the wick heater;

permeating the electrically conductive additive into the wick heater; and hardening the electrically conductive additive.

C2. A method of manufacture according to C1, wherein the wick heater is fibrous.

C3. A method of manufacture according to C2, wherein the fibers of the fibrous wick heater are electrically conductive.

C4. A method of manufacture according to C3, wherein the fibers include carbon fibers.

C5. A method of manufacture according to any of C1-C4, wherein the wick heater includes a fabric.

C6. A method of manufacture according to C5, wherein the fabric is woven.

C7. A method of manufacture according to C6, wherein the electrically conductive additive permeates into interstices between the yarns of the fabric.

C8. A method of manufacture according to any of C1-C7, wherein the electrical connection region includes first and second, separate, electrical connection region.

C9. A method of manufacture according to any of C1-C8, wherein the wick heater is planar.

C10. A method of manufacture according to C9, wherein the electrically conductive additive is applied to a planar surface of the planar wick heater.

C11. A method of manufacture according to any of C1-C10, wherein the electrically conductive additive is permeated into the wick heater to a permeation depth, wherein the permeation depth is less than a depth of the wick heater.

C12. A method of manufacture according to any of C1-C11, including flattening an exposed surface of the electrically conductive additive at the electrical connection region.

C13. A wick heater produced according to the method of any of C1-C12.

C14. A smoking substitute device including a wick heater according to C13.

C15. A smoking substitute system including a smoking substitute device according to C14, and further including a main body device for engagement with the smoking substitute device, the main body device including a power supply and at least one electrode, the at least one electrode being for electrical connection to a respective electrical connection region of the wick heater.

D1. A smoking substitute device including:

an elongate porous wick for conveying liquid aerosol forming substrate to a heating zone from a liquid supply location, a store for containing the liquid aerosol forming substrate for supply to the wick at the liquid supply location of the wick;

the wick including a pair of spaced electrical connection regions, the heating zone being located electrically between the pair of electrical connection regions;

wherein the wick is configured to have a lower liquid flow rate along the wick at at least one barrier region of the wick and a higher liquid flow rate of the liquid aerosol forming substrate along the wick outside the at least one barrier region, the at least one barrier region being located to promote maintenance of the liquid aerosol forming substrate in the heating zone and to inhibit flow of liquid aerosol forming substrate towards at least one of the electrical connection regions.

D2. A smoking substitute device according to D1, wherein the at least one barrier region is located between the electrical connection regions.

D3. A smoking substitute device according to D1 or D2, wherein the at least one barrier region includes two barrier regions.

D4. A smoking substitute device according to D3, wherein each of the two barrier regions is located on a respective side of the heating zone along the wick.

D5. A smoking substitute device according to any of D1-D4, wherein each barrier region substantially prevents liquid aerosol forming substrate being conveyed through the respective barrier region.

D6. A smoking substitute device according to any of D1-D5, wherein the wick is electrically conductive.

D7. A smoking substitute device according to D6, wherein the heating zone is a portion of the wick.

D8. A smoking substitute device according to any of D1-D7, wherein a barrier porosity of the wick in each barrier region is lower than a wick porosity outside the barrier region.

D9. A smoking substitute device according to D8, wherein the barrier porosity is at least 3 times lower than the wick porosity.

D10. A smoking substitute device according to any of D1-D9, wherein the wick is substantially planar, the wick having a major plane.

D11. A smoking substitute device according D10, wherein the major plane of the wick is substantially perpendicular to an in-use direction of airflow through the device.

D12. A smoking substitute device according to D10 or D11, wherein the liquid aerosol forming substrate is supplied to the wick in a direction substantially perpendicular to the major plane.

D13. A smoking substitute device according to any of D1-D12, wherein the wick is compressed to thereby form the at least one barrier region.

D14. A smoking substitute device according to D13, as dependent on D10, wherein the wick is compressed in a dimension perpendicular to the major plane of the wick.

D15. A smoking substitute device according to any of D1-D14, as dependent on D10, wherein each electrical contact region is for engagement with a respective electrical supply electrode from a direction perpendicular to the major plane.

E1. A smoking substitute device including:

an elongate planar heater for vaporizing an aerosol forming substrate, wherein the heater has a length in a longitudinal dimension, a width in a transverse dimension and a thickness in a depth dimension;

the heater having two mutually opposed transverse sides along the length of the heater;

wherein at least one of the two opposing transverse sides includes a convex curved portion, thereby reducing the width of the heater in the transverse dimension in a heating portion of the heater.

E2. A smoking substitute device according to E1, including an airflow passage that is formed between the convex curved portion and an adjacent heating chamber wall of the device.

E3. A smoking substitute device according to E2, wherein each of the two mutually opposed transverse sides include a respective convex curved portion.

E4. A smoking substitute device according to E3, wherein the curved portions are mutually convex with respect to one another.

E5. A smoking substitute device according to E3 or E4, including a respective airflow passage formed between each convex curved portion and a respective adjacent heating chamber wall of the device.

E6. A smoking substitute device according to any of E1-E5, wherein the heater is substantially symmetrical along a transverse axis of symmetry.

E7. A smoking substitute device according to any of E1-E6, wherein the heater is substantially symmetrical along a longitudinal axis of symmetry.

E8. A smoking substitute device according to any of E1-E7, wherein the heater is porous.

E9. A smoking substitute device according to any of E1-E8, wherein the heater is formed from a fabric, optionally wherein the fabric is woven.

E10. A smoking substitute device according to E9, wherein the fabric is electrically conductive.

E11. A smoking substitute device according to any of E1-E10, wherein the heater includes a pair of electrical connection regions, and wherein the heating portion is located electrically between the electrical connection regions.

E12. A smoking substitute device according to any of E1-E11, wherein the curved portion has a radius of curvature that is greater than 2 millimeters.

E13. A smoking substitute device according to any of E1-E12, wherein the curved portion has a radius of curvature that is less than 50 millimeters, optionally less than 10 millimeters.

E14. A smoking substitute system including a smoking substitute device according to any of E1-E13, and further including a main body device for engagement with the smoking substitute device, the main body device including a power supply and at least one electrode, the at least one electrode being for electrical connection to the heater.

What is claimed is:

1. A consumable assembly configured to be operatively connected to a main device by at least movement in a direction parallel to a longitudinal axis of the consumable assembly, the consumable assembly including:

an outer casing formed at least in part from a tank wall and an upstream plate connected to the tank wall and forming a base of the outer casing;

an electrically conductive porous wick heater housed within the outer casing and having a length, a width, a major plane and a thickness wherein an upstream face of the wick heater extends in the length and width directions along the major plane, and wherein the wick heater includes a heating portion on the major plane;

wherein at least one electrical contact region is formed on the upstream face of the wick heater wherein the upstream face of the wick heater is perpendicular to said movement so that said at least one electrical contact region is configured for engagement with a respective at least one electrical contact of the main device in a contact direction that is substantially parallel to said movement, the main device including a power supply for supplying electrical energy to the at least one electrical contact region via the at least one electrical contact; and wherein the upstream plate obscures at least a portion of the heating portion of the wick heater by covering at least a portion of the upstream face, wherein the upstream plate includes at least one electrical contact aperture through which the at least one respective electrical contact region of the wick heater is exposed from the smoking substitute device for direct engagement with the respective electrical contact.

2. A consumable assembly according to claim 1, wherein the wick heater is substantially planar.

3. A consumable assembly according to claim 1, wherein the wick heater is substantially planar and wherein the plane of the wick heater is substantially perpendicular to the longitudinal axis of the smoking substitute device.

4. A consumable assembly according to claim 1, wherein the wick heater is substantially planar and wherein each at least one electrical contact region is configured such that the respective electrical contact is incident on the respective electrical contact region from a direction perpendicular to the plane of the wick heater.

5. A consumable assembly according to claim 1, wherein the smoking substitute device includes a store for supplying aerosol forming substrate to the wick heater.

6. A consumable assembly according to claim 5, wherein the wick heater is substantially planar and wherein the aerosol forming substrate is supplied from the store to the wick heater along a direction substantially perpendicular to the plane of the wick heater.

7. A consumable assembly according to claim 5, wherein the aerosol forming substrate is supplied to the wick heater at at least one feed location on the wick heater, wherein the at least one electrical contact region includes a first electrical contact region and a second electrical contact region, and wherein the at least one feed location is located between the first electrical contact region and the second electrical contact region.

8. A consumable assembly according to claim 1, wherein the wick heater includes an electrically conductive fabric.

9. A consumable assembly according to claim 1, wherein the wick heater includes carbon fibers.

10. A smoking substitute system including, a consumable assembly according to claim 1, and the main device.

11. A smoking substitute system according to claim 10, wherein the at least one electrical contact includes a non-pointed electrical engagement region for direct engagement with the respective electrical contact region.

12. A smoking substitute system according to claim 11, wherein the non-pointed electrical engagement region includes a substantially flat portion.

13. A smoking substitute system according to claim 12, wherein the substantially flat portion is for co-planar engagement with the respective electrical contact region.

14. A consumable assembly according to claim 6, wherein the aerosol forming substrate is supplied to the wick heater at at least one feed location on the wick heater, wherein the at least one electrical contact region includes a first electrical contact region and a second electrical contact region, and wherein the at least one feed location is located between the first electrical contact region and the second electrical contact region.

* * * * *